US012607105B2

(12) United States Patent
Shannon et al.

(10) Patent No.: US 12,607,105 B2
(45) Date of Patent: Apr. 21, 2026

(54) FLOATLESS PUMPS AND CONTROL SYSTEMS

(71) Applicant: NEXTECH ENVIRONMENTAL, LLC, Spring, TX (US)

(72) Inventors: Joseph Lee Shannon, Spring, TX (US); Lee Thomas Jacobsen, Spring, TX (US); Jeffrey Johnston, Houston, TX (US)

(73) Assignee: NEXTECH ENVIRONMENTAL, LLC, Spring, TX (US)

( * ) Notice: Subject to any disclaimer, the term of this patent is extended or adjusted under 35 U.S.C. 154(b) by 204 days.

(21) Appl. No.: 18/242,696

(22) Filed: Sep. 6, 2023

(65) Prior Publication Data

US 2024/0076971 A1 Mar. 7, 2024

Related U.S. Application Data

(60) Provisional application No. 63/374,759, filed on Sep. 7, 2022.

(51) Int. Cl.
*E21B 43/12* (2006.01)
*E21B 47/047* (2012.01)
*F04F 1/08* (2006.01)

(52) U.S. Cl.
CPC ..... *E21B 43/129* (2013.01); *E21B 47/047* (2020.05); *F04F 1/08* (2013.01)

(58) Field of Classification Search
CPC ..... F04F 1/08; F04F 1/18–20; E21B 43/121–122; E21B 43/129; E21B 43/13; E21B 47/047
USPC ..... 417/108, 109
See application file for complete search history.

(56) References Cited

U.S. PATENT DOCUMENTS 555,785 A * 3/1896 Misic et al. ..... F04F 1/18 417/108
1,374,952 A * 4/1921 Rogers ..... F04F 1/20 417/109
1,754,945 A * 4/1930 Haskell ..... F04F 1/06 417/86

(Continued)

FOREIGN PATENT DOCUMENTS

DE 102016102730 B3 * 1/2017
WO WO-9820232 A1 * 5/1998 ..... B09C 1/002

(Continued)

*Primary Examiner* — Alexander B Comley
(74) *Attorney, Agent, or Firm* — CLEARPAT SERVICES, LLC

(57) ABSTRACT

An improved pump device and control system for removal of liquid, such as viscous leachate, from a bore. A pump device includes a casing with an inlet check valve on a lower portion thereof and a discharge check valve on an upper portion thereof positioned within the casing. A fill cavity within the casing is connectable to a source of pressurized gas. As liquid/viscous leachate accumulates within the bore it enters the fill cavity through the inlet check valve. As pressurized gas is introduced to the fill cavity it displaces liquid/leachate from the fill cavity into and through a discharge tube and upward through the discharge check valve to remove the liquid/leachate from the fill cavity. The pump does not comprise a float. Control systems and devices provide for improved automated, semi-automated, and manual monitoring and control of pump device operation.

39 Claims, 19 Drawing Sheets

(56) References Cited

U.S. PATENT DOCUMENTS 3,106,170 A * 10/1963 Gray ..... E21B 34/06 417/138
3,797,968 A * 3/1974 Elfarr ..... F04F 1/02 417/145
3,814,545 A * 6/1974 Waters ..... E21B 43/121 417/90
3,873,238 A * 3/1975 Elfarr ..... E21B 43/12 417/54
4,545,731 A * 10/1985 Canalizo ..... F04F 1/08 417/86
4,974,673 A * 12/1990 Chacin ..... E21B 41/02 166/106
5,004,405 A * 4/1991 Breslin ..... F04F 1/08 417/40
5,373,897 A * 12/1994 Skarvan ..... B09C 1/002 166/250.03
5,431,222 A * 7/1995 Bustamante ..... E21B 43/121 166/310
5,611,671 A * 3/1997 Tripp, Jr. ..... E21B 43/121 417/118
5,641,272 A * 6/1997 Harrold ..... F04F 1/08 417/133
5,806,598 A * 9/1998 Amani ..... E21B 43/121 137/155
5,868,280 A * 2/1999 Schroeder ..... B67D 1/04 222/64
5,944,490 A * 8/1999 Breslin ..... F04F 1/08 417/134
5,971,715 A * 10/1999 Breslin ..... F04B 53/1015 137/512.1
6,027,314 A * 2/2000 Breslin ..... F04F 1/08 417/134
6,045,336 A * 4/2000 Webb ..... B01D 17/0214 210/170.07
6,048,175 A * 4/2000 Corlew ..... F04F 1/08 417/139
6,162,020 A * 12/2000 Kondo ..... F04F 1/08 417/54
6,234,761 B1 * 5/2001 Kocsis ..... E21B 43/121 417/147
10,415,603 B1 * 9/2019 Sommese ..... F04F 1/18
11,261,883 B2 * 3/2022 Schaupp ..... F15D 1/0015
2002/0040785 A1 * 4/2002 Amani ..... F04F 1/08 166/373
2012/0125624 A1 * 5/2012 Dyer ..... E21B 43/129 166/105.3
2012/0273278 A1 * 11/2012 Zhu ..... E21B 27/00 175/206
2014/0356194 A1 * 12/2014 Ahmed ..... F04F 1/18 417/65
2016/0258262 A1 * 9/2016 Lemetayer ..... E21B 43/122
2018/0313369 A1 * 11/2018 Breslin ..... F04F 1/08
2019/0113040 A1 * 4/2019 Wendland ..... F04F 1/08
2019/0308226 A1 * 10/2019 Schaupp ..... B08B 5/02
2019/0353185 A1 * 11/2019 Schaupp ..... F04F 5/42
2021/0115768 A1 * 4/2021 Schaupp ..... F04F 1/08
2021/0199109 A1 * 7/2021 Wendland ..... F04B 9/1273
2022/0290694 A1 * 9/2022 Schaupp ..... F04B 53/10

FOREIGN PATENT DOCUMENTS

WO WO-9915756 A2 * 4/1999 ..... E21B 43/121
WO WO-2015123633 A1 * 8/2015 ..... E21B 43/121
WO WO-2018050157 A1 * 3/2018 ..... C02F 3/12
WO WO-2020263349 A1 * 12/2020 ..... E21B 43/13

* cited by examiner

SECTION E-E

SECTION G-G

SECTION H-H

FLOATLESS PUMPS AND CONTROL SYSTEMS

CROSS-REFERENCE

This application claims the benefit of U.S. Provisional Application No. 63/374,759, filed Sep. 7, 2022, which application is incorporated herein by reference.

BACKGROUND OF THE INVENTION

The present invention relates generally to well pumps, and more specifically, to submersible well pumps for removing accumulated liquids from a landfill. Landfills can accumulate liquids due to rain, the breakdown of landfill contents, and other possible causes. The liquids can include leachate chemicals which are preferably removed from the landfill or at least monitored. As such, landfill wells are equipped with pumps to remove the liquids. In some cases, the pumps are used to lower the water table within the landfill, while in other cases, the pumps are used to remove liquid for sampling. Operating in the landfill environment requires the pumps to transport liquids which can vary greatly in viscosity and various highly corrosive chemicals at high temperatures generated by chemical decomposition of landfill contents. Pumps should be capable of operating in this environment while also having high reliability at reasonable costs and energy consumption.

Unfortunately, existing pumps for removal of liquid leachate rely on mechanical floats and are plagued by performance issues due to frequent failures and associated maintenance and repair. Most existing designs include floats and linkages that are prone to fouling and sticking within the pump bores resulting in frequent pump malfunction. Additionally, for similar reasons, these same pumps are only functional in a vertical orientation and will quickly foul and fail in non-vertical or deviated orientations when the float will stick to the interior walls of the pump housing as it attempts to float upward.

Further, since liquid detection by the float occurs within the interior of the pump, any failures due to the float typically require the pump to be removed from the bore and disassembled to access the interior of the pump for cleaning, repair, and replacement of parts. This is a laborious process which increases human exposure to field conditions potentially comprising various highly corrosive chemicals at high temperatures generated by chemical decomposition of landfill contents which may result in Health, Safety and Environment incidents. Finally, existing pumps require regular, manual oversight, which results in greater opportunities for human error to interrupt or impede pump operation.

Accordingly, there is a need for improved pumps that operate without the need for mechanical floats, that are more rugged and robust for use in a variety of bore shapes and operational scenarios, and that are capable of being monitored and/or controlled by a surface-based control system to enhance, complement, or replace manual oversight of pump operation. The present invention addresses these unmet needs. Accordingly, various aspects of improved well pump design are referenced herein.

SUMMARY OF THE INVENTION

In one aspect, the disclosure provides a submersible floatless pneumatic fluid pump system for use in a landfill wellbore; the fluid pump system comprising a control system, a pump casing with a proximal and distal end, extending along an axis and at least partially defining an interior of the fluid pump, a pneumatic inlet control valve/vent valve operably connected to a pressurized gas source and a proximal endcap on the pump casing, via a gas inlet/vent line, to an internal fill cavity, a fluid inlet on the distal end of the pump casing, an inlet check valve at the distal end of the pump casing disposed between the fluid inlet and the fill cavity of the interior of the fluid pump, a discharge check valve in the proximal end of the pump casing distal to the proximal endcap, a fluid outlet discharge line having a discharge outlet and a distal end operatively connected to the proximal endcap of the pump casing and operably connected to the discharge check valve and a free-hanging discharge tube within the pump casing disposed within the fill cavity and operably connected proximally to the discharge check valve, wherein the fluid inlet is configured to allow liquid/viscous leachate to enter the pump below the inlet check valve, wherein the inlet check valve is configured to allow one way passage of the liquid/viscous leachate into the fill cavity and prevent said liquid/viscous leachate from returning to the wellbore, wherein the pneumatic inlet control valve/vent valve controls the flow of pressurized gas to the fill cavity to force liquid/viscous leachate into a distal end of the free-hanging discharge tube and up to the discharge check valve and wherein said discharge check valve operably serves to connect to the fluid outlet discharge line and prevent discharged liquid/viscous leachate from returning to the fill cavity.

In most embodiments of the floatless pneumatic pump system, said pump does not comprise a fluid float and is configurable for either vertical, non-linear, or deviated well applications.

In some embodiments, the floatless pneumatic pump system further comprises a liquid sensor located proximal to and outside of the fluid pump along the fluid outlet discharge line that is operably connected to the discharge check valve.

In some embodiments of the floatless pneumatic pump system, the liquid sensor is external to the fluid pump and accessible at grade level, without the need to remove the fluid pump from the wellbore.

In some embodiments of the floatless pneumatic pump system, the liquid sensor comprises: an optical sensor, or a resistive sensor, or a capacitive sensor, or an ultrasonic sensor, or a photoelectric sensor, or a combination thereof.

In some embodiments of the floatless pneumatic pump system, the free-hanging discharge tube is flexible, stationary, bent, curved or straight. In some embodiments, the free-hanging discharge tube may be structurally ridged or non-movable.

In some embodiments of the floatless pneumatic pump system, the free-hanging discharge tube further comprises a weighted inlet nozzle and is flexibly moveable within the fill cavity.

In some embodiments, the floatless pneumatic pump system further comprises a gas vent line operably connected to said pneumatic inlet control valve/vent valve, configured to release and vent the pressurized gas out of the fill cavity and cease the push transfer of the accumulated liquid/viscous leachate from the fill cavity.

In some embodiments, the floatless pneumatic pump system further comprises a pneumatic turbine provided in line with the source of pressurized gas and configured to provide either a primary or an alternate source of power.

In some embodiments of the floatless pneumatic pump system, the distal portion of the pump casing further comprises an expanded portion to effectively increase the capacity of the fill cavity.

In some embodiments of the floatless pneumatic pump system, the free-hanging discharge tube further comprises a weighted inlet nozzle and is flexibly moveable within the expanded portion of the fill cavity.

In some embodiments of the floatless pneumatic pump system, the pump casing is flexible, insertable, and operable in a wellbore that is non-linear or deviated.

In some embodiments of the floatless pneumatic pump system, the control system is configured to monitor pump cycles, control pump cycles, or monitor and control pump cycles.

In some embodiments of the floatless pneumatic pump system, the control system comprises: a power source, one or more processors, additional sensors, memory storage for data collection of pump apparatus functions and one or more transmitters and receivers, wherein said power source comprises: batteries, the electrical power grid, or a solar cell or a pneumatic turbine or a combination thereof, wherein said one or more processors are configured to execute computer-readable instructions stored on at least one non-transitory computer-readable medium, comprising test procedures such as a control loop; wherein said additional sensors comprise: an air pressure sensor or a liquid sensor or a conductive digital sensor or a resistive sensor, an ambient temperature sensor or a solar sensor or a battery voltage sensor or monitor or a combination thereof within the system; wherein said memory storage comprises non-transitory computer readable medium; wherein said transmitters are configured to transmit stored data from memory storage to a remote device directly via direct connections or between client devices and electronic controller devices or indirectly via indirect connections and wherein said receivers are configured to receive control instructions from client devices.

In some embodiments of the floatless pneumatic pump system, the control system, the system employs an array of other sensors for diagnostic measurements.

In a preferred embodiment of the floatless pneumatic pump system, the control system power source will utilize batteries as a primary power source and further comprise back-up power sources including components such as a solar panel, a wind turbine, a pneumatic turbine and/or the power grid, or a combination thereof, for charging the batteries or running the system in lieu of battery failure.

In some embodiments of the floatless pneumatic pump system, the one or more processors comprise a 32 bit microcontroller (ESP32).

In some embodiments, the floatless pneumatic pump system further comprises: one or more server devices for remotely controlling and monitoring the pump apparatus or transmission of pump apparatus operation data or instructions.

In some embodiments, the electronic controller could comprise a PC, a server, a raspberry PI, an Arduino open-source hardware and software platform, an ARM processor, a PIC microcontroller, or a digital signal processor, to name but a few.

In some embodiments of the floatless pneumatic pump system, the memory storage for the control system comprises the use of SD card memory storage. In alternative embodiments, the system may employ FLASH memory or any other form of non-volatile memory.

In some embodiments, the electronic controller uses the WIFI capability of the 32 bit microcontroller (ESP32) for transmitting data and receiving instructions. In some embodiments, the electronic controller could transmit and receive data via Bluetooth, BLE (low energy Bluetooth), LORA, Zigbee, cellular, etc.

In some embodiments of the floatless pneumatic pump system, the electronic controller is configured with a control loop configured to perform periodic test purges to determine if liquid/viscous leachate is present in the discharge line, as evidenced by the liquid sensor, wherein, if liquid/viscous leachate is present in the discharge line, said electronic controller will instruct said fluid pump to activate and continue pumping for a set period of time, a number of cycles, or until at least a minimum desired value of liquid/viscous leachate is detected, and wherein if less than a minimum desired value of liquid/viscous leachate is detected in the discharge line, said control loop will instruct said fluid pump to go into a timed standby mode and wait a period of time before performing another test cycle or test purge, thus repeating the cycle.

In some embodiments of the floatless pneumatic pump system, the electronic controller control loop activates a purge cycle by causing said pneumatic inlet control valve/vent valve to open and inject pressurized gas into the fill cavity of the pump, thereby forcing accumulated liquid/viscous leachate into the free-hanging discharge tube, through the discharge check valve, out through the fluid outlet discharge line and past the liquid sensor to the discharge outlet.

In some embodiments of the floatless pneumatic pump system, said electronic controller control loop activates a standby mode by causing said pneumatic inlet control valve/vent valve to close and causing said gas vent line to open, releasing pressurized gas from the fill cavity of the pump, and allowing the pump to fill through the inlet check valve, until the standby mode times out.

In some embodiments, the floatless pneumatic pump system further comprises a secondary gas inlet/vent line, and a secondary pneumatic inlet control valve/vent valve with secondary gas vent line, operably connected to the pressurized gas source, to facilitate rapid transfer of accumulated liquid/viscous leachate from the fill cavity.

In another aspect, a floatless pneumatic fluid pump apparatus suitable for use in a landfill well, holding pond, filtration pond, oil well, water well or pool is described; the fluid pump comprising: a pump casing having a proximal and distal end extending along an axis and at least partially defining an interior of the fluid pump, a proximal endcap, a fluid inlet, a fluid outlet, a gas inlet/vent line, a fill cavity within the pump casing, a fluid outlet discharge line operably connected to the proximal endcap and the fluid outlet, an inlet check valve within the distal end of the pump casing disposed between the fluid inlet and the fill cavity, and configured to allow one-way passage of liquid/viscous leachate into the fill cavity, a discharge check valve configured to prevent discharged liquid/viscous leachate from returning to the fill cavity, a free-hanging discharge tube within the fill cavity, and disposed between the inlet check valve and operably connected to the discharge check valve, a pneumatic inlet control valve/vent valve, operable connected to the proximal endcap and a pressurized gas source with the gas inlet/vent line and configured to introduce pressurized gas to the interior of the fluid pump and vent pressurized gas from the interior of the fluid pump and a liquid sensor positioned along the fluid outlet discharge line prior to the discharge outlet, configured to sense the presence of liquid/viscous leachate in the fluid outlet discharge line and actuate the pneumatic inlet control valve/vent valve.

In most embodiments of the floatless pneumatic pump apparatus, said pump does not comprise a fluid float and is configurable for either vertical, non-linear or deviated well applications.

In some embodiments of the floatless pneumatic pump apparatus, the free-hanging discharge tube is flexible, stationary, bent, curved, straight or a combination thereof.

In some embodiments of the floatless pneumatic pump apparatus, the free-hanging discharge tube further comprises a weighted inlet nozzle.

In some embodiments, the floatless pneumatic pump apparatus further comprises a distal portion of the pump casing comprising an expanded portion to effectively increase the capacity of the fill cavity.

In some embodiments of the floatless pneumatic pump apparatus, the free-hanging discharge tube further comprises a weighted inlet nozzle and is flexibly moveable within the expanded portion of the fill cavity.

In some embodiments of the floatless pneumatic pump apparatus, the pump casing is flexible, insertable, and operable in a wellbore that is non-linear or deviated.

In some embodiments, the floatless pneumatic pump apparatus further comprises a pneumatic turbine provided in line between the source of pressurized gas and the fluid pump and configured to provide an alternate source of power.

In some embodiments, the floatless pneumatic pump apparatus further comprises a secondary gas inlet/vent line, a secondary pneumatic inlet control valve/vent valve, and a secondary gas vent line operably connected to the pressurized gas source to facilitate rapid transfer of accumulated liquid/viscous leachate from the fill cavity.

In some embodiments, the floatless pneumatic pump apparatus further comprises a secondary pneumatic turbine provided in line between the source of pressurized gas and the fluid pump and configured to provide an alternate source of power.

In some embodiments of the floatless pneumatic pump apparatus, the liquid sensor is positioned proximally to and outside of the pump at grade level.

In some embodiments of the floatless pneumatic pump apparatus, the liquid sensor comprises: an optical sensor, or a capacitive sensor, or a resistive sensor, or an ultrasonic sensor, or a photoelectric sensor, or a combination thereof.

In some embodiments of the floatless pneumatic pump apparatus, the liquid sensor is configured to send input data to a control system regarding the detection of liquid/viscous leachate in the fluid outlet discharge line, which in turn controls the function of the pneumatic inlet control valve/vent valve.

In some embodiments of the floatless pneumatic pump apparatus, the pneumatic inlet control valve/vent valve is operably connected to a gas vent line, configured to release and vent the pressurized gas out of the fill cavity.

In some embodiments of the floatless pneumatic pump apparatus, the pump apparatus is configured for remote operation by a control system comprising: a power source, a computer processor configured to execute computer-readable instructions, memory systems comprising non-transitory computer readable medium, a server, an audio/video output, an input device, a signal generation device, and a communication interface; wherein said control system is configured to monitor pump components and execute multiple loop procedures comprising: purge procedures, standby procedures, and component test procedures.

In some embodiments of the floatless pneumatic pump apparatus, the control system receives data from the liquid sensor indicating the presence or absence of liquid/viscous leachate in the fluid outlet discharge line, whereby the control system determines the need to activate one or more of the multiple loop procedures.

In some embodiments of the floatless pneumatic pump apparatus, the purge procedure comprises: the control system receiving data from a sensor indicating the existence of a known amount of liquid/viscous leachate in the pump apparatus; opening the pneumatic inlet control valve/vent valve, allowing gas from a pressurized gas source to enter the fill cavity via a gas inlet/vent line, forcing accumulated liquid/viscous leachate in the fill cavity to enter the free-hanging discharge tube, into and through the discharge check valve, into the fluid outlet discharge line, past the liquid sensor and out of the discharge outlet, until said accumulated liquid/viscous leachate is evacuated from the pump; closing the pneumatic inlet control valve/vent valve, allowing gas from the pressurized fill cavity to return to the pneumatic inlet control valve/vent valve (19) via the bi-directional gas inlet/vent line (21), and vent to the atmosphere through a gas vent line, operably connected to said pneumatic inlet control valve/vent valve.

In some embodiments of the floatless pneumatic pump apparatus, the standby procedure comprises: the control system receiving data from a sensor, indicating the absence of a known amount of liquid/viscous leachate in the fluid outlet discharge line; allowing the fluid pump to rest for a specific time period, allowing viscous/leachate the opportunity to fill the fill cavity of the pump before retesting the pump with a test procedure to determine if a known amount of liquid/viscous leachate has re-accumulated in the pump apparatus.

In some embodiments of the floatless pneumatic pump apparatus, the test procedure comprises: the control system receiving data from a sensor in the pump on a regular or periodic basis to determine if a known amount of liquid/viscous leachate has accumulated or is present in either the fill tank or the fluid outlet discharge line; wherein, if liquid/viscous leachate is detected, then the fluid pump may be directed to continue with additional pump cycles to remove the leachate from the fill cavity and the wellbore; or wherein, if liquid/viscous leachate is not detected, then the fluid pump may enter a standby period until the test procedure is repeated.

In some embodiments of the floatless pneumatic pump apparatus, the power source for a control system comprises: the electrical power grid, batteries, or a solar cell, or a pneumatic turbine, or a combination thereof.

In some embodiments of the floatless pneumatic pump apparatus, the inlet check valve further comprises internal protrusions configured to provide a stop that determines a maximum opening for said inlet check valve.

In another aspect, the disclosure provides a control system, comprised of electronic circuitry and/or computational devices, for monitoring and/or controlling the pump device and the liquid sensor. A control system may include an element that may be positioned proximal to and operably connected to the pump device for operation of the pump device and capture of pump statuses and sensor results and may include an element that may be positioned proximally or distally to the pump device, such as one or more client devices and/or one or more server devices for remotely controlling and monitoring the pump device through manual, semi-automatic, or automatic procedures. Controller devices may be operably connected to server devices for transmission of pump device operational data to the server devices for storage and access by one or more client devices.

Client devices may access server devices to enable technicians to retrieve and view information about pump system operation and, in some instances, to transmit control instructions to the controller device directly via direct connections between client devices and controller devices or indirectly via indirect connections, for example, connections with server devices. A variety of different types, amounts, embodiments and configurations of electronic circuitry and/or computational devices that together may constitute a control system are provided.

In another aspect, a control system for a floatless pneumatic pump system for use in a landfill wellbore is described, said control system comprising: a computer processor; a non-transitory computer readable memory; a network communication interface device; a BUS; a power source; and a power storage device.

In another aspect, a method of regulating levels of liquid leachate in a landfill wellbore with a floatless pneumatic fluid pump is described, the floatless pneumatic fluid pump comprising; a pump casing with a proximal and distal end, extending along an axis and at least partially defining an interior of the fluid pump, a pneumatic inlet control valve/vent valve with vent operably connected to a pressurized gas source via a gas inlet/vent line to an internal fill cavity; a free-hanging discharge tube within the internal fill cavity disposed between an inlet check valve and a discharge check valve; a fluid outlet discharge line having a discharge outlet, and a liquid sensor positioned along the fluid outlet discharge line prior to the discharge outlet, the method comprising: inserting said floatless pneumatic fluid pump in the landfill wellbore; allowing leachate to enter and accumulate in the fill cavity through the inlet check valve; actuating a pneumatic inlet control valve/vent valve to allow pressurized gas to enter and pressurize the internal fill cavity through a gas inlet/vent line; causing said inlet check valve to close and discharge check valve to open; forcing said accumulated leachate in the fill cavity to enter a distal end of the free-hanging discharge tube and pass through said discharge check valve, into said discharge line, said discharged leachate, passing a liquid sensor prior to reaching the discharge outlet; deactivating the pneumatic inlet control valve/vent valve to stop the flow of pressurized gas into the fill cavity; opening the vent to allow pressurized gas in the fill cavity to exhaust to atmosphere through the gas inlet/vent line; causing said discharge valve to close and said inlet check valve to open; and allowing leachate to enter and accumulate in the fill cavity through the inlet check valve.

In some embodiments of the method, additional sensors monitor atmospheric and subterranean pressure within the pump, wherein said data is reported out to and recorded by a control system for said pump.

In some embodiments of the method, additional sensors monitor either the presence of, or amount of liquid within the pump, wherein said data is reported out to and recorded by a control system for said pump.

In another aspect, a method of regulating fluid levels in a well, sump, pond or pool with a floatless pneumatic fluid pump and control system is described, the floatless pneumatic fluid pump comprising a pump casing with a proximal and distal end, extending along an axis and at least partially defining an interior of the fluid pump, a pneumatic inlet control valve/vent valve with vent operably connected to a pressurized gas source via a gas inlet/vent line to an internal fill cavity; a free-hanging discharge tube within the internal fill cavity disposed between an inlet check valve and a discharge check valve; a fluid outlet discharge line having a discharge outlet, and a liquid sensor positioned along the fluid outlet discharge line prior to the discharge outlet, the method comprising: sensing for the presence of a predetermined amount of fluid in the fluid outlet discharge line with the liquid sensor and wherein if said predetermined amount of fluid is present in the discharge line; pressurizing the internal fill cavity to purge said fluid via the gas inlet/vent line by activating said pneumatic inlet control valve/vent valve operably connected to the pressurized gas source; causing said inlet check valve to close and said discharge valve to open; forcing said accumulated liquid in the fill cavity to enter a distal end of the free-hanging discharge tube and pass through said open discharge check valve, into said discharge line, said discharged liquid, passing the liquid sensor prior to reaching the discharge outlet; maintaining said pressurized gas source flow until less than the predetermined amount of fluid level is detected by the fluid sensor; deactivating the pneumatic inlet control valve/vent valve to stop the flow of pressurized gas into the fill cavity; opening the vent to allow pressurized gas in the fill cavity to exhaust to atmosphere through the gas inlet/vent line; causing said discharge valve to close and said inlet check valve to open; allowing liquid to enter and accumulate in the fill cavity through the open inlet check valve.

In some embodiments, the method, further comprising: using an automated electronic controller to monitor and instruct said fluid pump components to activate and deactivate utilizing control loop programs; wherein pressurized pumping continues for a set period of time, a number of cycles, or until at least a minimum desired value of fluid is detected, and wherein if less than the predetermined amount of fluid level is detected in the discharge line by the liquid sensor, said control loop program will instruct said fluid pump to go into a timed standby mode and wait a period of time before performing another test purge, thus repeating the cycle.

In another aspect, a floatless pneumatic fluid pump apparatus suitable for use in a non-landfill applications is described; the fluid pump comprising: a pump casing having a proximal and distal end extending along an axis and at least partially defining an interior of the fluid pump, a proximal endcap, a fluid inlet, a fluid outlet, a gas inlet/vent line, a fill cavity within the pump casing, a fluid outlet discharge line operably connected to the proximal endcap and the fluid outlet, an inlet check valve within the distal end of the pump casing disposed between the fluid inlet and the fill cavity, and configured to allow one-way passage of liquid into the fill cavity, a discharge check valve configured to prevent discharged liquid from returning to the fill cavity, a free-hanging discharge tube within the fill cavity, and disposed between the inlet check valve and operably connected to the discharge check valve, a pneumatic inlet control valve/vent valve, operable connected to the proximal endcap and a pressurized gas source with the gas inlet/vent line and configured to introduce pressurized gas to the interior of the fluid pump and vent pressurized gas from the interior of the fluid pump and a liquid sensor positioned along the fluid outlet discharge line prior to the discharge outlet, configured to sense the presence of liquid in the fluid outlet discharge line and actuate the pneumatic inlet control valve/vent valve.

In most embodiments of the floatless pneumatic pump apparatus, said pump does not comprise a float switch or fluid float and is further configurable for various applications involving sufficiently deep ponds, holding ponds, filtration ponds or pools to allow for transfer to holding tanks or other ponds and pools.

Additional aspects and advantages of the present disclosure will become readily apparent to those skilled in this art from the following detailed description, wherein only exemplary embodiments of the present disclosure are shown and described, simply by way of illustration of the several modes or best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

The foregoing and other features of the present disclosure will become apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF THE INVENTION

The present invention is directed to a landfill well pump for controlling liquid levels within the landfill.

Figure 1A:
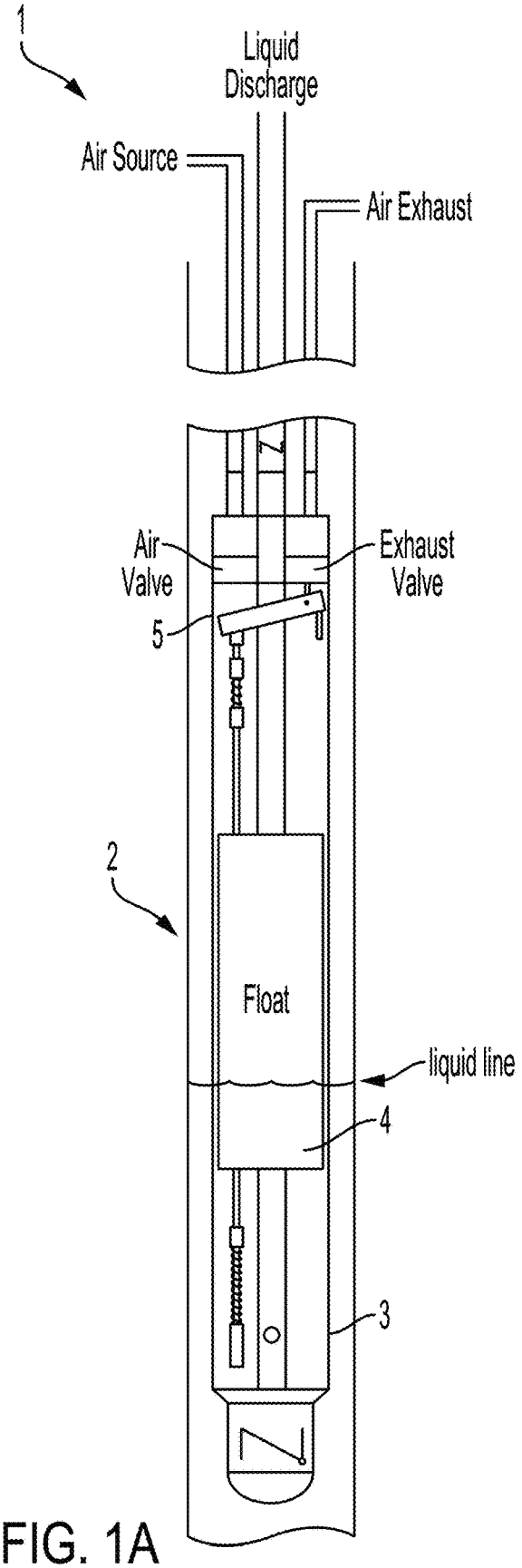
FIG. 1A PRIOR ART
FIG. 1A is a representative example of a prior art leachate pump with a float switch and fluid level float apparatus therein.
Figure 1B:
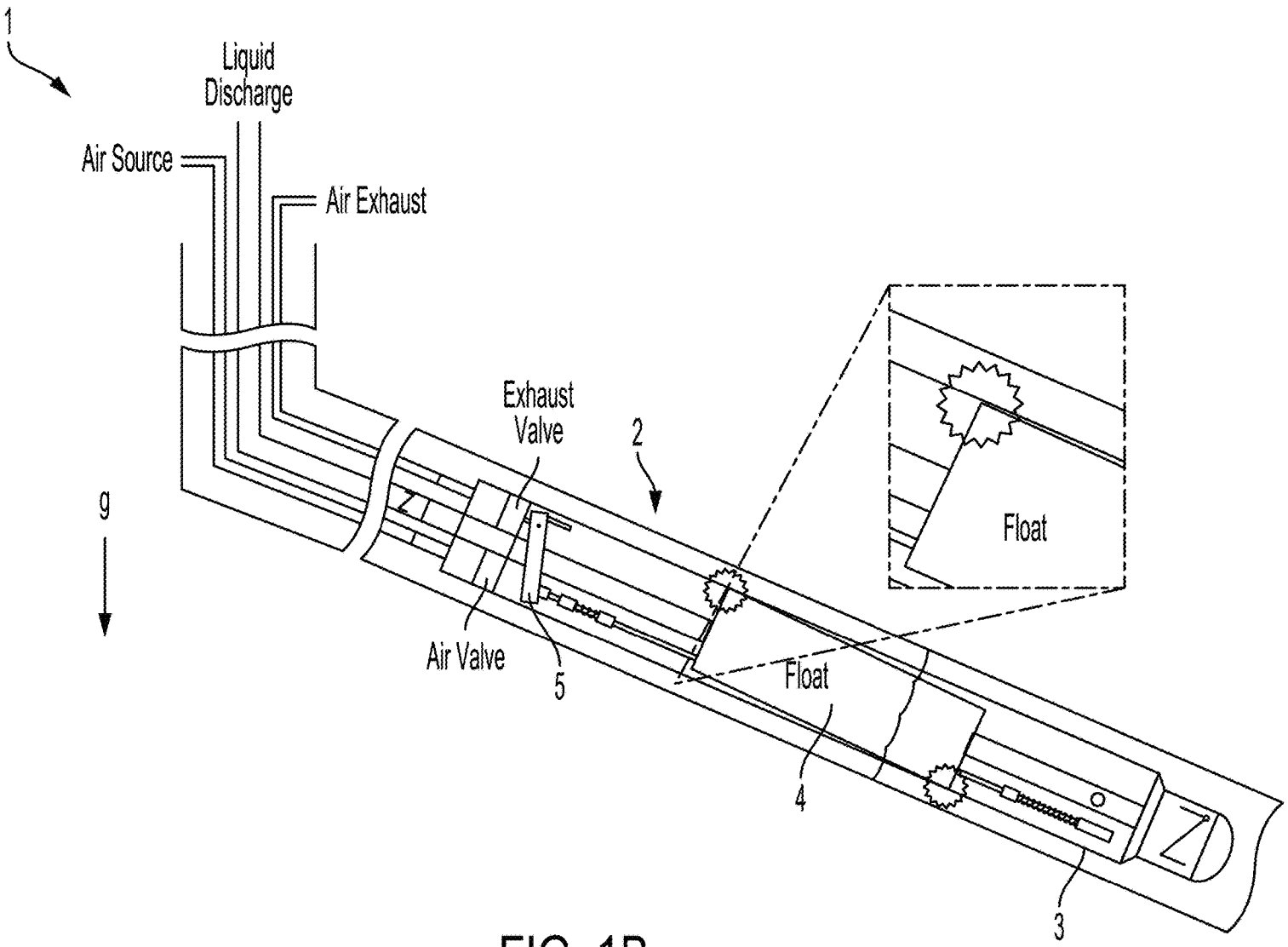
FIG. 1B PRIOR ART
FIG. 1B is a representative example of a prior art leachate pump with a float switch and an impinged fluid level float in a deviated wellbore.

FIGS. 1A & 1B are representative examples of prior art leachate pump systems 1 having pumps 2 with a housing 3, a fluid level float 4 and float switch 5 therein. As illustrated in FIG. 1B in particular, pump systems of this type are particularly susceptible to jamming and clogging from the extremely viscous and corrosive leachate liquids and slurry found in such wells but are even more likely to foul in non-vertical and deviated wellbores due to the floats becoming lodged along the inner wall of the pump casing and/or rubbing on the center rod and mechanical linkages of the float switch mechanism.

The present inventive device will now be described more fully hereinafter with reference to the accompanying drawings which illustrate embodiments of the submersible floatless pneumatic fluid pump system. This submersible floatless pneumatic fluid pump system may, however, be embodied in many different forms and should not be construed as limited to the illustrated embodiments set forth herein. Rather, these embodiments are provided so that this disclosure will be thorough and complete, and will fully convey the scope of the device to those skilled in the art.

The following description of the exemplary embodiments refers to the accompanying drawings. The following detailed description does not limit the invention. Instead, the scope of the invention is defined by the appended claims.

Reference throughout the disclosure to "an exemplary embodiment," "an embodiment," or variations thereof means that a particular feature, structure, or characteristic described in connection with an embodiment is included in at least one embodiment of the subject matter disclosed. Thus, the appearance of the phrases "in an exemplary embodiment," "in an embodiment," or variations thereof in various places throughout the disclosure is not necessarily referring to the same embodiment. Further, the particular features, structures or characteristics may be combined in any suitable manner in one or more embodiments.

As used herein, and unless otherwise specified, the term "about" or "approximately" means an acceptable error for a particular value as determined by one of ordinary skill in the art, which depends in part on how the value is measured or determined. In certain embodiments, the term "about" or "approximately" means within 1, 2, 3, or 4 standard deviations. In certain embodiments, the term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 mm, 30.0 mm, 20.0 mm, 10.0 mm 5.0 mm 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 5.0 kg, 2.5 kg, 1.0 kg, 0.9 kg, 0.8 kg, 0.7 kg, 0.6 kg, 0.5 kg, 0.4 kg, 0.3 kg, 0.2 kg or 0.1 kg of a given value or range, including increments therein. In certain embodiments, the term "about" or "approximately" means within 1 hour, within 45 minutes, within 30 minutes, within 25 minutes, within 20 minutes, within 15 minutes, within 10 minutes, within 5 minutes, within 4 minutes, within 3 minutes within 2 minutes, or within 1 minute. In certain embodiments, the term "about" or "approximately" means within 20.0 degrees, 15.0 degrees, 10.0 degrees, 9.0 degrees, 8.0 degrees, 7.0 degrees, 6.0 degrees, 5.0 degrees, 4.0 degrees, 3.0 degrees, 2.0 degrees, 1.0 degrees, 0.9 degrees, 0.8 degrees, 0.7 degrees, 0.6 degrees, 0.5 degrees, 0.4 degrees, 0.3 degrees, 0.2 degrees, 0.1 degrees, 0.09 degrees. 0.08 degrees, 0.07 degrees, 0.06 degrees, 0.05 degrees, 0.04 degrees, 0.03 degrees, 0.02 degrees or 0.01 degrees of a given value or range, including increments therein.

As used herein, and unless otherwise specified, the term "plurality", and like terms, refers to a number (of things) comprising at least one (thing), or greater than one (thing), as in "two or more" (things), "three or more" (things), "four or more" (things), etc.

As used herein, the terms "connected", "operationally connected", "coupled", "operationally coupled", "operationally linked", "operably connected", "operably coupled", "operably linked," and like terms, refer to a relationship (mechanical, linkage, coupling, etc.) between elements whereby operation of one element results in a corresponding, following, or simultaneous operation or actuation of a second element. It is noted that in using said terms to describe inventive embodiments, specific structures or mechanisms that link or couple the elements are typically described. However, unless otherwise specifically stated, when one of said terms is used, the term indicates that the actual linkage or coupling may take a variety of forms, which in certain instances will be readily apparent to a person of ordinary skill in the relevant technology.

As used herein, the terms "comprises", "comprising", or any other variation thereof, are intended to cover a nonexclusive inclusion, such that a process, method, article, or apparatus that comprises a list of elements does not include only those elements but may include other elements not expressly listed or inherent to such process, method, article, or apparatus.

Whenever the term "at least," "greater than," or "greater than or equal to" precedes the first numerical value in a series of two or more numerical values, the term "at least," "greater than" or "greater than or equal to" applies to each of the numerical values in that series of numerical values. For example, greater than or equal to 1, 2, or 3 is equivalent to greater than or equal to 1, greater than or equal to 2, or greater than or equal to 3.

Whenever the term "no more than," "less than," or "less than or equal to" precedes the first numerical value in a series of two or more numerical values, the term "no more than," "less than," or "less than or equal to" applies to each of the numerical values in that series of numerical values. For example, less than or equal to 3, 2, or 1 is equivalent to less than or equal to 3, less than or equal to 2, or less than or equal to 1.

As used herein, and unless otherwise specified, the term "deviated" "non-linear" or "irregular" and like terms, means or refers to a wellbore that is deflected at an angle from vertical. A deviated well may have a range of vertical deviation from the surface between about 0.050 and about 90.00° (horizontal). The deviated well may be minimally vertically deviated from a perfectly vertical orientation by as little as 1°-3°, or may be severely deviated in excess of 45°, up to as much as 90° (horizontal) from a vertical orientation or essentially parallel to the surface from where the wellbore is drilled. Deviated, non-linear or irregular may also refer to a wellbore that essentially "wavers" or has minor to major deviations in relative straightness throughout the length of the wellbore.

As used in FIG. 10 at least, and elsewhere herein, a vertical/longitudinal axis Y-Y is indicated by upward and downward directions ("upward", "up", "upper", "top", and "above", or "downward", "down", "lower", "bottom", and "below" are terms used herein interchangeably).

As used herein, and unless otherwise specified, the term "anterior" refers to and means the front surface of a body or structure; often used to indicate the position of one structure relative to another, that is, situated nearer the front part of the structure. Alternately, it may also refer in a similar fashion to an apparatus.

As used herein, and unless otherwise specified, the term "posterior" refers to and means the back surface of a structure; Often used to indicate the position of one structure relative to another, that is, nearer the back of the structure. Alternately, it may also refer in a similar fashion to an apparatus.

As used herein, and unless otherwise specified, the terms "superior" and "proximal" refer to and mean situated nearer the vertex, top or head of a structure in relation to a specific reference point; opposite of inferior. It may also mean situated above or directed upward. Alternately, it may also refer in a similar fashion to an apparatus.

As used herein, and unless otherwise specified, the terms "inferior" and "distal" refer to and means situated nearer the bottom or foot of a structure in relation to a specific reference point; opposite of superior. It may also mean situated below or directed downward. Alternately, it may also refer in a similar fashion to an apparatus.

As used herein, the term "proximity" means nearness in space or relationship, but not excluding the potential to be touching. Proximity is also alternatively meant to mean that one thing may be so close to another thing as to be "in direct or nearly direct contact" (in proximity) with another thing along some point. To "place something in proximity" is also meant to mean that items are "paired" or "mated together" either in their paired function or at some point of contact.

As used herein, and unless otherwise specified, the term "vertically oriented" and similar terms mean; generally perpendicular to, at, or near, right angles to a horizontal plane; in a direction or having an alignment such that the top of a thing is above the bottom. In certain embodiments, the term "vertically oriented" means within ±20.0 degrees, ±15.0 degrees, ±10.0 degrees, +9.0 degrees, ±8.0 degrees, ±7.0 degrees, ±6.0 degrees, ±5.0 degrees, ±4.0 degrees, ±3.0 degrees, ±2.0 degrees, ±1.0 degrees, +0.9 degrees, +0.8 degrees, +0.7 degrees, +0.6 degrees, ±0.5 degrees, +0.4 degrees, +0.3 degrees, +0.2 degrees or 0.1 degrees of a given value or range, including increments therein.

As used herein, and unless otherwise specified, the term "horizontally oriented" and similar terms mean; generally perpendicular to, at, or near, right angles to a vertical plane; in a direction or having an alignment such that the top of a thing is generally on, or near the same plane as the bottom, both being parallel or near parallel to the horizon. In certain embodiments, the term "horizontally oriented" means within ±20.0 degrees, ±15.0 degrees, ±10.0 degrees, +9.0 degrees, ±8.0 degrees, ±7.0 degrees, ±6.0 degrees, ±5.0 degrees, ±4.0 degrees, ±3.0 degrees, ±2.0 degrees, ±1.0 degrees, +0.9 degrees, +0.8 degrees, +0.7 degrees, +0.6 degrees, ±0.5 degrees, +0.4 degrees, +0.3 degrees, +0.2 degrees or +0.1 degrees of a given value or range, including increments therein.

As used herein, and unless otherwise specified, the term "substantially perpendicular" and similar terms mean generally at or near 90 degrees to a given line, or surface or to the ground. In certain embodiments, the term "substantially perpendicular" means within ±20.0 degrees, ±15.0 degrees, ±10.0 degrees, +9.0 degrees, ±8.0 degrees, ±7.0 degrees, ±6.0 degrees, ±5.0 degrees, ±4.0 degrees, ±3.0 degrees, ±2.0 degrees, ±1.0 degrees, +0.9 degrees, +0.8 degrees, +0.7 degrees, +0.6 degrees, ±0.5 degrees, ±0.4 degrees, ±0.3 degrees, +0.2 degrees or 0.1 degrees of a given value or range, including increments therein.

As used herein, and unless otherwise specified, the term "check valve", "inlet check valve", "outlet check valve" and similar terms mean or refer to one-way valves, which by definition functions only to allow fluid(s) to flow in one direction. The main function of a check valve is to ensure that the fluid only moves in one direction and does not flow backwards even when the pump switches off.

As used herein, and unless otherwise specified, the term "floatless" and similar terms mean or refer to a pump that does not comprise a buoyant fluid level float or a float switch.

As used herein, and unless otherwise specified, the terms "leachate", "liquid", "liquid/leachate" and similar terms mean or refer to landfill leachate and its composition. As known to those in the art; basically, a mixture of organic and inorganic substances, dissolved or entrained environmentally harmful substances, compounds in solution and in colloidal state, and several species of microorganisms. The impact produced by leachate in the environment is directly related to their stage of decomposition. It is most commonly used in the context of land-filling of putrescible or industrial waste. In the narrow environmental context, leachate is therefore any liquid material that drains from land or stockpiled material and contains significantly elevated concentrations of undesirable material derived from the material that it has passed through.

As used herein, and unless otherwise specified, combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

In FIGS. 2, 3, 4, 7 and 9 are illustrative embodiments of a submersible floatless pneumatic fluid pump system 6 for use in a landfill wellbore.

Figure 2:
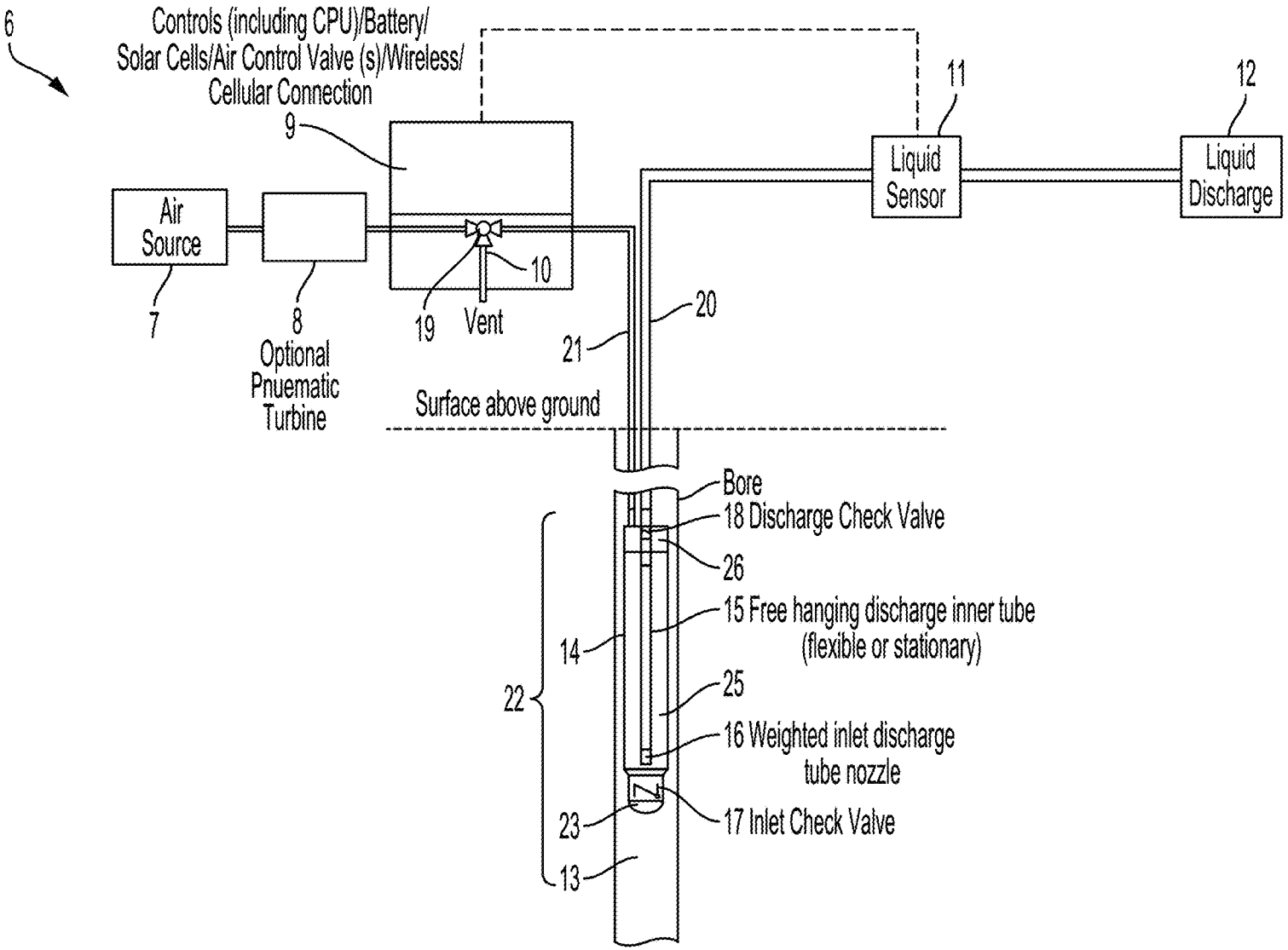
FIG. 2 is a representative embodiment of a new floatless pneumatic leachate pump system without a fluid level float.

As shown in FIG. 2, a submersible floatless pneumatic fluid pump system 6 for use in a landfill wellbore 13, or holding pond, filtration pond, oil well, water well or pool, is illustrated. The fluid pump system comprises a digital control system 9, a floatless pump 22 with a pump casing 14 having a proximal and distal end, extending along an axis (Y-Y, shown in FIG. 10) and at least partially defining an interior of the fluid pump; a pneumatic 3-way inlet control valve/vent valve 19 having a gas vent line 10, operably connected to a pressurized gas source 7 and a proximal endcap 26 on the pump casing, via a bi-directional gas inlet/vent line 21. In some embodiments the gas vent line 10 comprises a 3-way valve or a 3×2 or 5/2 solenoid. The bi-directional gas inlet/vent line 21 operably connects to an internal fill cavity 25 within the pump casing. The submersible floatless pneumatic fluid pump 22 has a fluid inlet 23 on the distal end of the pump casing, an inlet check valve 17 at the distal end of the tubular pump casing 14 disposed between the fluid inlet 23 and the fill cavity 25 of the interior of the fluid pump and further comprises a discharge check valve 18 in the proximal end of the pump casing, either within or distal to the proximal endcap 26. The discharge check valve 18 operably connects to a fluid outlet discharge line 20 having a proximal discharge outlet 12 and having a distal end operatively connected to the proximal endcap 26 of the pump casing and the discharge check valve. Internally, a free-hanging discharge tube 15 within the pump casing disposed within the fill cavity 25 is operably connected proximally to the discharge check valve 18 and comprises a distal (free-hanging) end 16 extending into the of the fill cavity.

In operation, the submersible floatless pneumatic fluid pump system is configured such that the bull-nosed fluid inlet 23 comprising a plurality of slotted openings allows liquid/viscous leachate 30 to enter the pump through an inlet check valve 17, wherein the inlet check valve is configured to allow one way passage of the liquid/viscous leachate into the fill cavity 25 and prevent said liquid/viscous leachate 30 from returning to the wellbore 13.

At periodic intervals, the digital control system 9 instructs the pneumatic inlet control valve/vent valve to allow the flow of pressurized gas 7 via the bi-directional gas inlet/vent line 21 to the fill cavity to force the accumulated liquid/viscous leachate into the distal end 16 of the free-hanging discharge tube 15 and up to the discharge check valve 18, where said discharge check valve operably serves to connect to the fluid outlet discharge line 20 and prevent the discharged liquid/viscous leachate 30 from returning to the fill cavity. The discharged liquid/viscous leachate then passes through the fluid outlet discharge line, past either an in-line or non-invasive external liquid sensor 11 that records and reports the presence of the liquid/viscous leachate in the line, as it continues towards the liquid discharge 12 where it is expelled to a storage tank (not shown).

As noted previously, the submersible floatless pneumatic fluid pump system of the present application is unique in that it does not have a fluid float or float switch mechanism that can be fouled by the debris or corrosive liquids in the leachate. The functions served by those components of conventional designs are replaced by an external (not within the pump casing), in-line or non-invasive external liquid sensor 11 located along the discharge line 20 and the digital control system 9 used to monitor the liquid sensor and the other components of the fluid pump system 6.

An added benefit of the design is that it eliminates a known issue with these types of pumps when used in non-linear or deviated wellbores, where the floats and float switch mechanisms will frequently become fouled and stick to the casing walls and along the float rods due to corrosion and debris caused by the liquid/leachate in the wellbore.

The in-line or non-invasive external liquid sensor 11 can be located anywhere along the discharge line, either above or below ground, but is preferably placed above grade for easier access, repair, or replacement, if needed.

The system is configurable such that the in-line or non-invasive external liquid sensor 11 can be any one of a large variety of known sensors including but not limited to optical, resistive, capacitive, ultrasonic, or photoelectric sensors, or a combination thereof.

Figure 3:
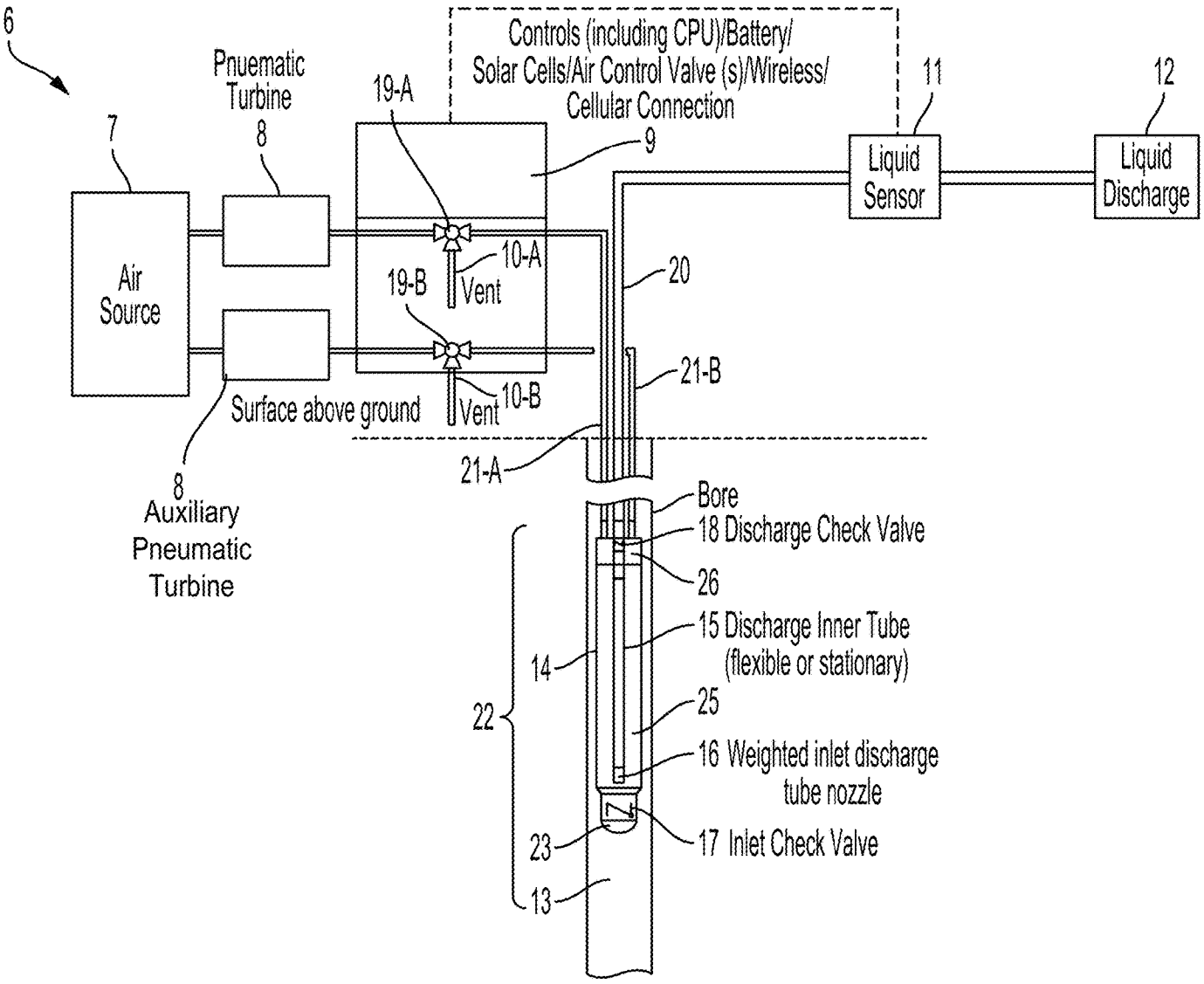
FIG. 3 is another representative embodiment of a new floatless pneumatic leachate pump system without a fluid level float as shown in FIG. 2, having primary and auxiliary pneumatic lines and vents.

As shown in FIG. 3, the system is further configurable to allow for the addition of auxiliary (additional) gas inlet and exhaust components. In at least some embodiments, the pump system and device may include a primary gas inlet valve 19A, an auxiliary gas inlet valve 19B, a primary vent 10A, and an auxiliary vent 10B configured to fluidly connect source(s) of pressurized gas 7 via a primary bi-directional gas inlet/vent line 21A and an auxiliary bi-directional gas inlet/vent line 21B to the fill cavity 25 to rapidly transfer the liquid from the fill cavity. Rapid pump cycles may be beneficial in circumstances where a rapid removal of liquid from a landfill bore, or other space, is needed. Such an approach may be beneficial for rapid removal of liquid from a space in response to a flash flooding event, for example, or rapid filling of wells or transferring from a source of ground water in event of emergency, e.g., firefighting.

Figure 4:
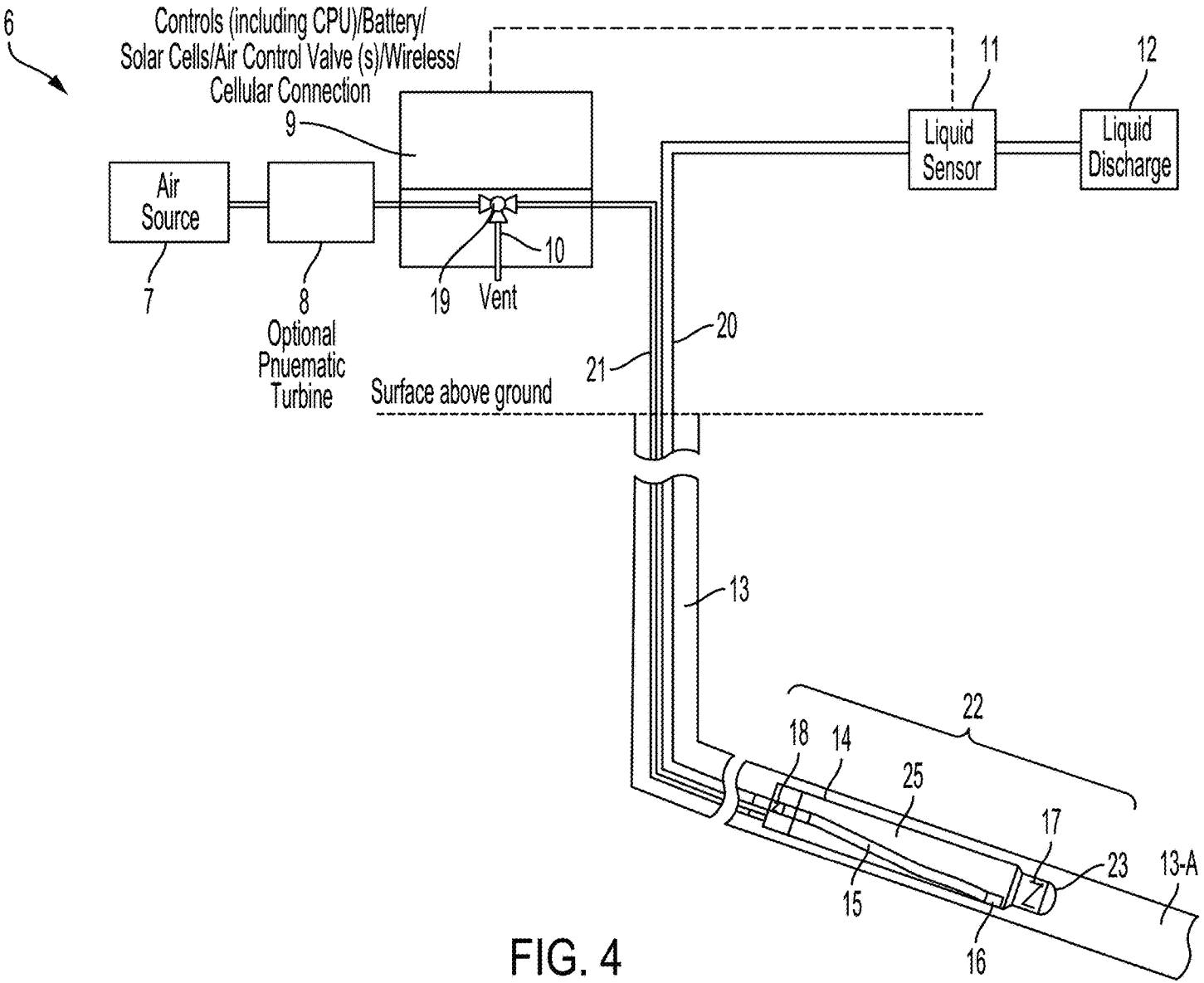
FIG. 4 is another representative embodiment of a new floatless pneumatic leachate pump system without a fluid level float as shown in FIG. 2, illustrated in a deviated wellbore.
Figure 5:
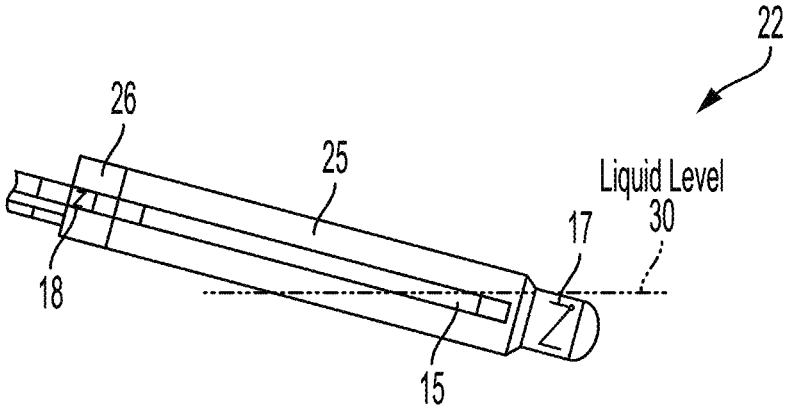
FIG. 5 is a representative view of the pump shown in FIG. 4 with a straight discharge tube.

As shown in FIGS. 4 and 5, the submersible floatless pneumatic fluid pump system is further configurable for use in a deviated well environment where the wellbore 13A is at an angle other than 90° from the surface.

As shown in FIG. 4, the pump 22 can be placed in the deviated wellbore 13A, theoretically at any deviation angle between at least 1° and 90° from vertical. The pump would further comprise a free-hanging flexible discharge tube 15, preferably with a weighted distal end 16 that would encourage the end of the discharge tube to lay in the lowest possible portion of the tubular fill space 25. At this orientation, the discharge tube would be able to maximize the amount of accumulated liquid/leachate in the pump fill space. The stiffness of the free-hanging discharge tube 15 is variable and configurable. The free-hanging discharge tube 15 is variable in length and can be configurable to be flexible, stationary, bent, curved or straight, to accommodate the wellbore and pump configuration best suited to each application of the system. In some embodiments, the free-hanging discharge tube may be structurally ridged or non-movable.

Figure 6:
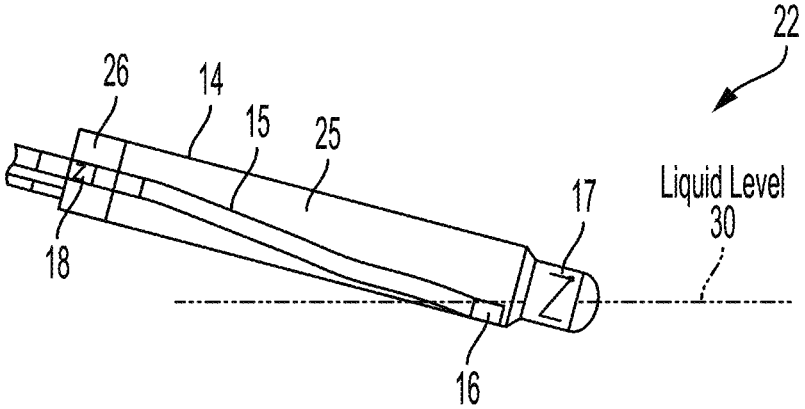
FIG. 6 is a representative view of the pump shown in FIG. 4 with a flexible discharge tube having a weighted end.

As shown in FIG. 5, if a straight free-hanging discharge tube 15 were selected for a deviated well application, the end of the straight discharge tube would be unable to pull all of the accumulated liquid/leachate 30 from the fill space 25, whereas, as shown in FIG. 6, a flexible, curved or bent free-hanging discharge tube 15 with a weighted end 16 would rest at the lowest point in the fill space 25, as shown in FIG. 4.

Figure 7:
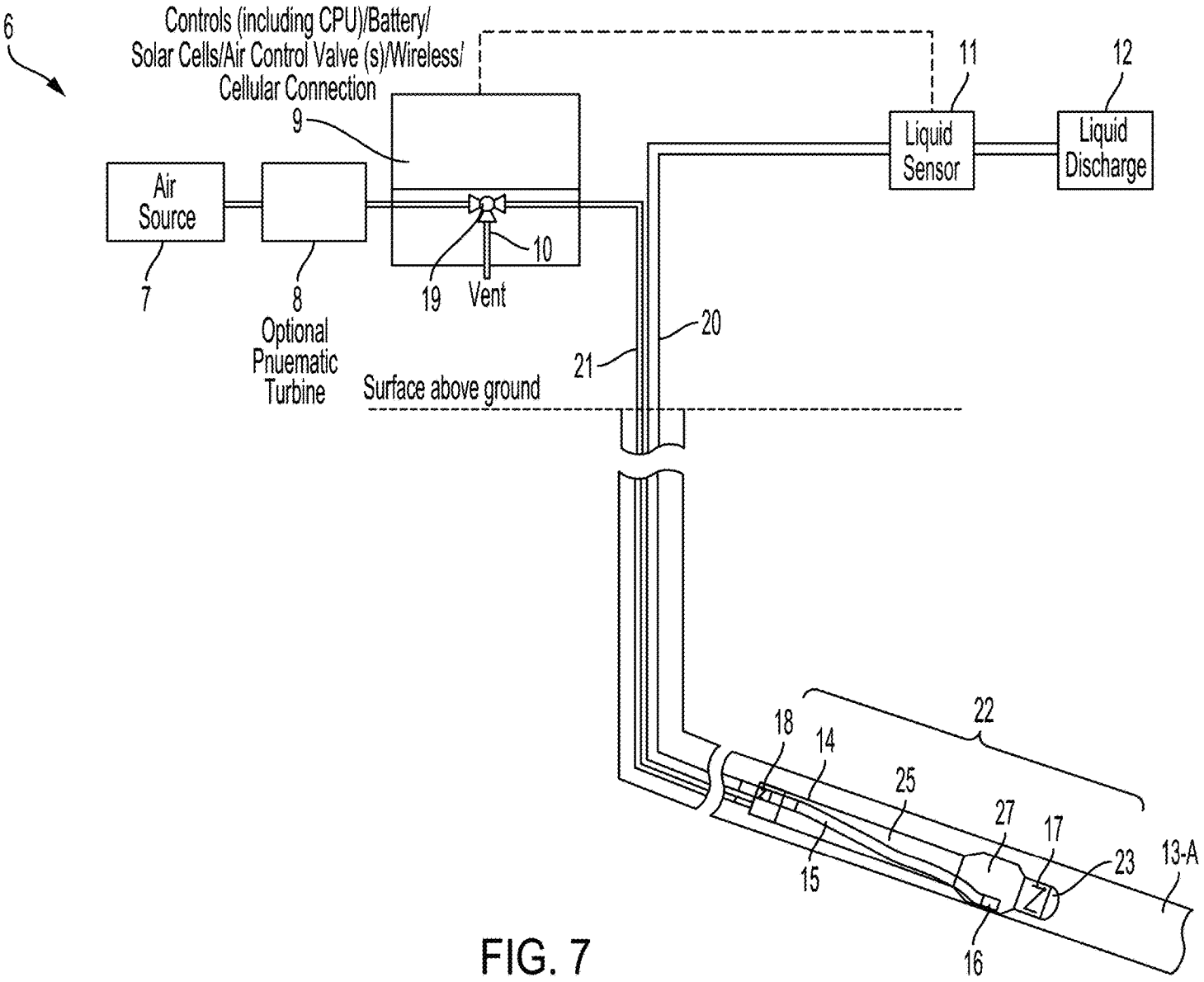
FIG. 7 is another representative embodiment of a new floatless pneumatic leachate pump system without a fluid level float as shown in FIG. 4, illustrated in a deviated wellbore and having an expanded fill space in the body of the pump casing.
Figure 8:
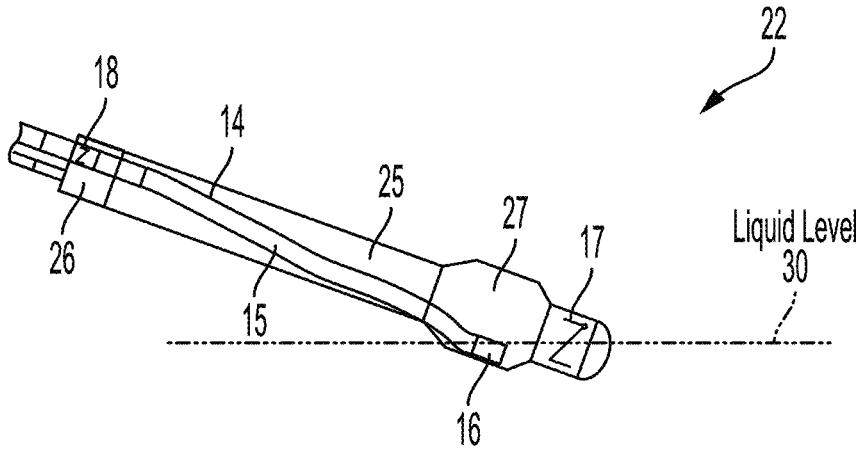
FIG. 8 is a representative detailed view of the pump shown in FIG. 7 with a flexible discharge tube having a weighted end in the expanded fill space in the body of the pump casing.

In yet another embodiment, as shown in FIG. 7, the lower portion of the casing further includes an expanded portion 27 that increases the capacity of the fill cavity. In some embodiments of the submersible floatless pneumatic pump 22, it may be advantageous to have a narrower proximal portion of the pump casing and a larger, expanded distal portion 27. The expanded portion of the lower portion of the casing includes a larger radius and can hold a larger volume of liquid compared to adjacent portions of the casing. In addition, when the pump is oriented horizontally or in another non-vertical orientation, as shown in FIG. 8, the expanded portion may provide a lower resting point for a weighted inlet nozzle 16 of the when present in the design. In this manner, as the liquid level becomes lower as a result of operation of the pump device 22, the inlet nozzle can continue to take in liquid and continue to lower the liquid level in the well bore 13A.

In some embodiments, the expanded distal portion 27 of the casing may be detachable and separable from the casing body 14.

Figure 9:
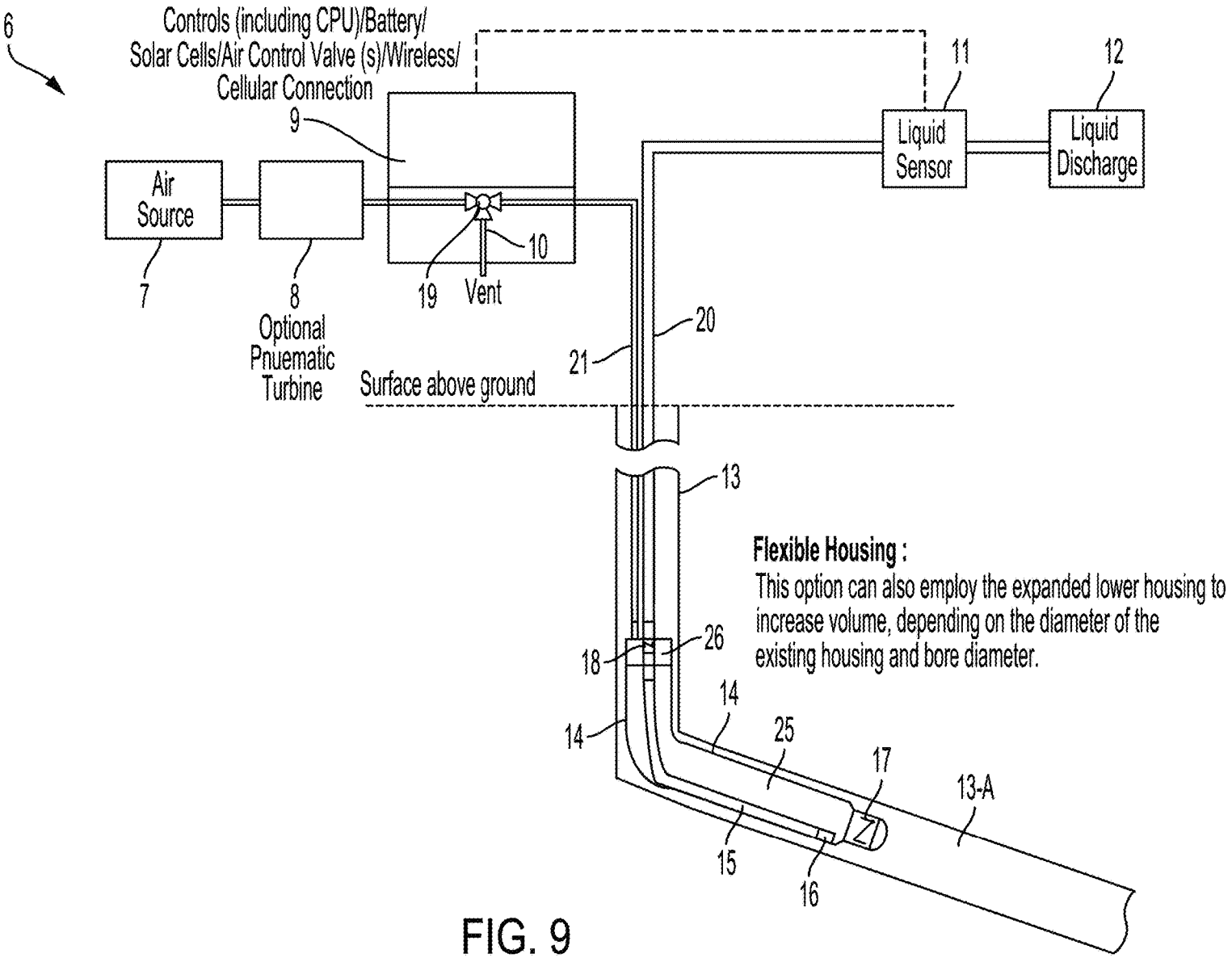
FIG. 9 is another representative embodiment of a new floatless pneumatic leachate pump system without a fluid level float as shown in FIG. 4, illustrated in a deviated wellbore and having flexible pump casing capable of bending within a deviated portion of a deviated wellbore.

In yet another embodiment, the casing 14 may be rigid or, alternatively, as shown in FIG. 9, the casing of the pump 22 may be flexible. A flexible casing 14 may be used in combination with a free-hanging flexible discharge tube 15 to allow the casing 14 to bend around corners and adapt to fit and/or operate within deviated, non-linear or irregular bores. In this manner, the pump device 22 may be operated in a wider variety of circumstances and is more operationally robust compared to existing pump devices. In some embodiments, the casing and discharge tube may comprise or be configured from stainless-steel braided casing or stainless-steel braided hosing. Other alternative materials may include flexible polyethylene, nylon, or PVC.

In yet another embodiment, (not shown), the submersible floatless pneumatic pump 22 may further comprise a combination of features, such as the flexible casing 14 as shown in FIG. 9; the narrower proximal portion of the pump casing 14 and the larger, expanded distal portion 27, as shown in FIGS. 7 & 8; and include any variation and length of the free-hanging flexible discharge tube 15 as previously described and shown in FIGS. 4-8. For example; a deviated wellbore may be more easily navigated and penetrated with a pump casing 14 having an expanded distal portion 27 with a relatively shorter length along with a narrower proximal casing section with a longer length. Additionally, said longer section of narrow proximal casing may be fabricated from a flexible material, making it better suited to flex in sharper deviated sections of wellbore. Such a configuration would allow for comparable volumes of liquid/leachate collection within the pump fill cavity when compared to straight wellbores having a pump casing with a single diameter.

Figure 10:
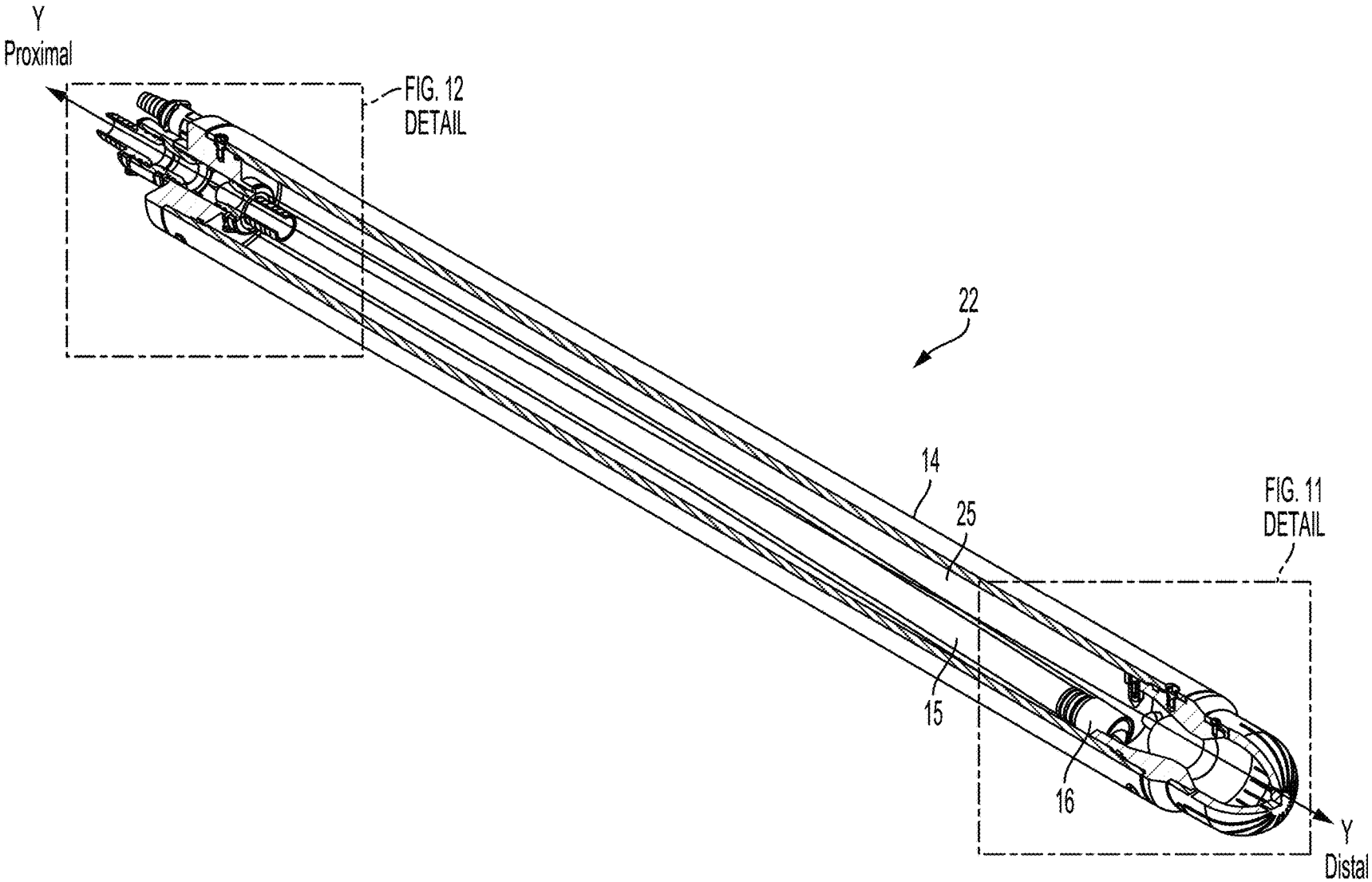
FIG. 10 is a representative view of the new floatless pneumatic leachate pump, illustrating a cut-away section and detail views of the proximal and distal ends of the pump illustrated in FIGS. 11 and 12.
Figure 11:
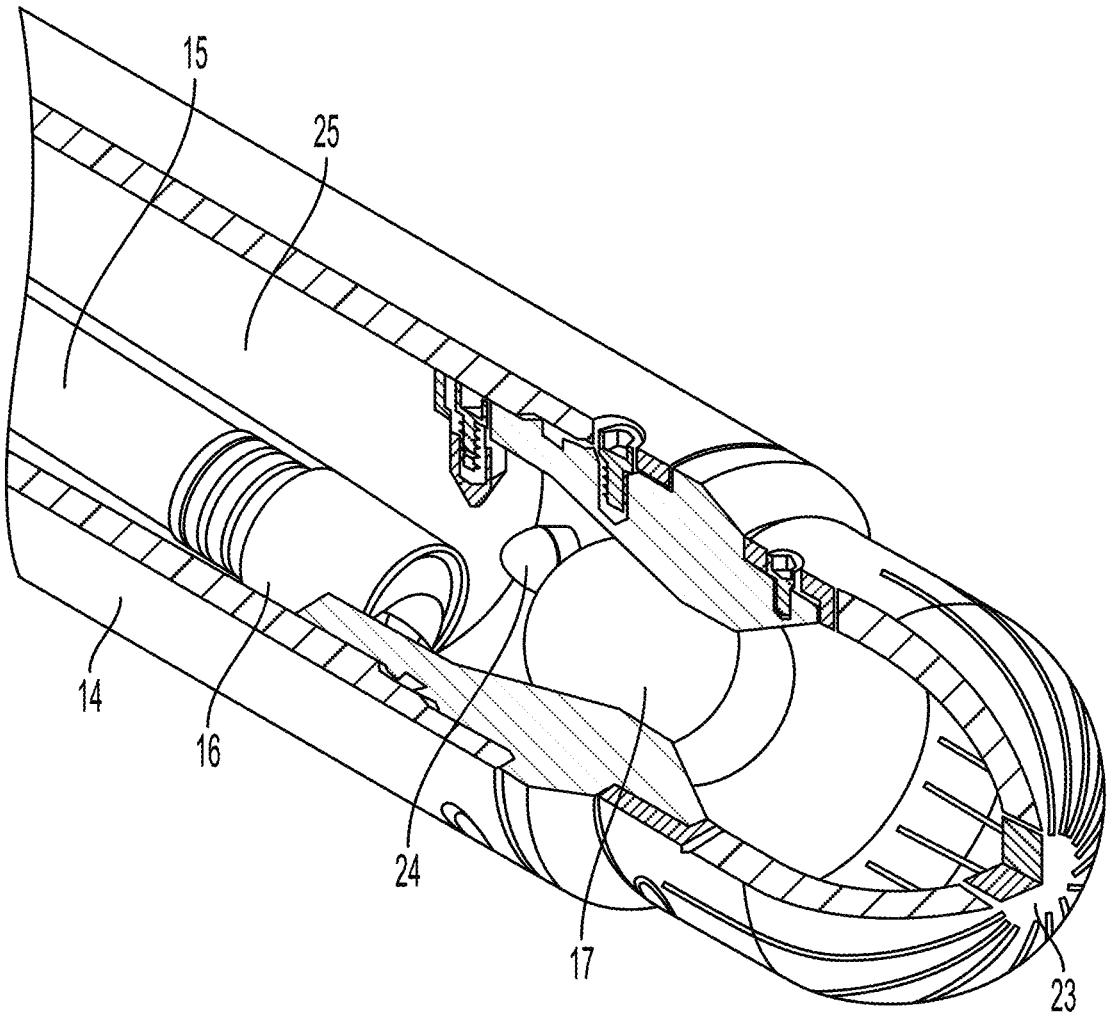
FIG. 11 is a representative detailed view of the distal end of the pump illustrated in FIG. 10.
Figure 12:
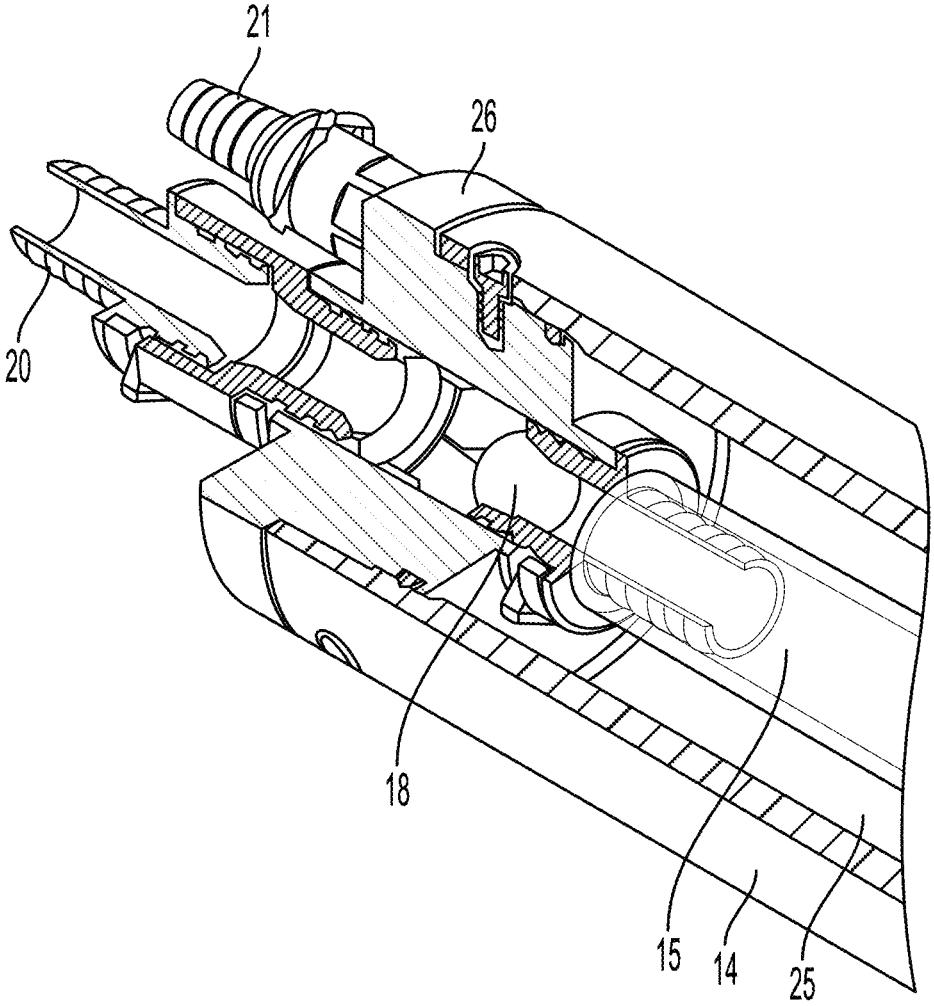
FIG. 12 is a representative detailed view of the proximal end of the pump illustrated in FIG. 10.

FIG. 10 is an illustrative embodiment of the submersible floatless pneumatic pump 22, illustrating the longitudinal axis Y-Y, the casing 14, having a cut-away section of the entire length of the casing and the fill space 25 therein, showing the free-hanging discharge tube 15 with the distal end 16, and detail views of the proximal and distal ends of the pump illustrated in FIGS. 11 and 12.

FIG. 11 is a representative detailed view of the distal end of the pump 22 illustrated in FIG. 10. As shown therein, the distal end of the pump illustrates a slotted bull-nose shaped fluid inlet 23, configured to allow liquid/leachate (within an acceptable range of viscosity and density) to enter the fill cavity 25 through the one-way inlet check valve 17. For example, the liquid/leachate found in landfills can often have a viscosity range from approximately 1 centipoise (cP) to approximately 500 cP. Or said another way, leachate may commonly have an approximate dynamic viscosity within a range between that of water and 40 SAE weight motor oil. However, one of skill in the art will also recognize that it is not uncommon for leachate and other "liquids" found in landfills, (holding ponds, filtration ponds, etc.), where pumps such as this may be employed, often encounter higher viscosity liquids, often mixed with varying degrees of debris which more closely resembles a slurry or a sludge, such as that found in a range of industrial processes, from water treatment, wastewater treatment, sewage or on-site sanitation systems. In some environments, the viscosity of slurry encountered by these pumps may have a range up to approximately 2000 cP, with an approximate equivalent of up to nearly 5% or 6% content of solids in the leachate.

Also shown within the inlet check valve 17 are protrusions, shown as cap nuts 24, to provide a maximum opening for the inlet check valve 17, as liquid enters the fill cavity 25 through the inlet check valve 17. The distal (weighted) end 16 of the free-hanging discharge tube is illustrated as sitting near the inlet check valve 17 at or about the bottom surface of the fill space 25 within the tubular casing 14.

FIG. 12 is a representative detailed view of the proximal end of the pump 22 illustrated in FIG. 10. As shown therein, the proximal end of the pump illustrates a bi-directional gas inlet/vent line 21 operably connected to the proximal endcap 26 and by extension, to the internal fill cavity 25. Also shown is a connection for the fluid outlet discharge line 20, operably connected to the one-way discharge check valve 18, which is operably connected to the proximal end of the free-hanging discharge tube 15.

Figure 13:
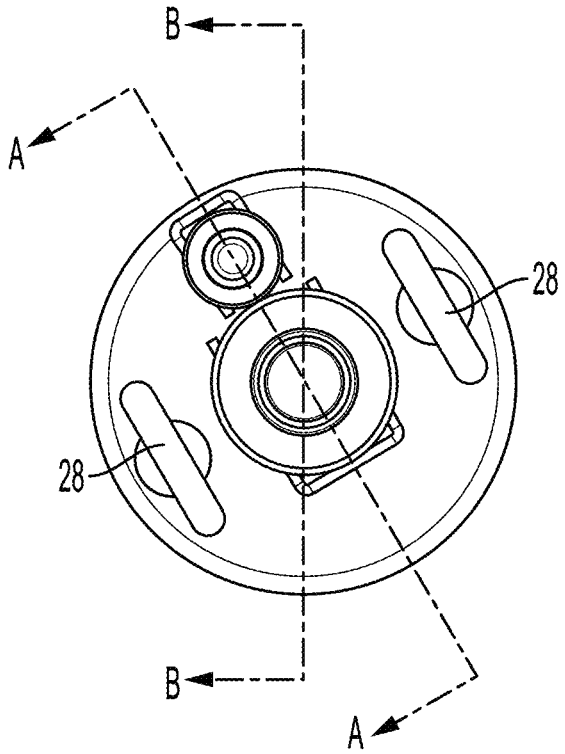
FIG. 13 illustrates a representative top view of the proximal portion of the pump illustrated in FIG. 10, with section lines indicating cutaway views visible in FIGS. 14A and 14B.
Figure 14A:
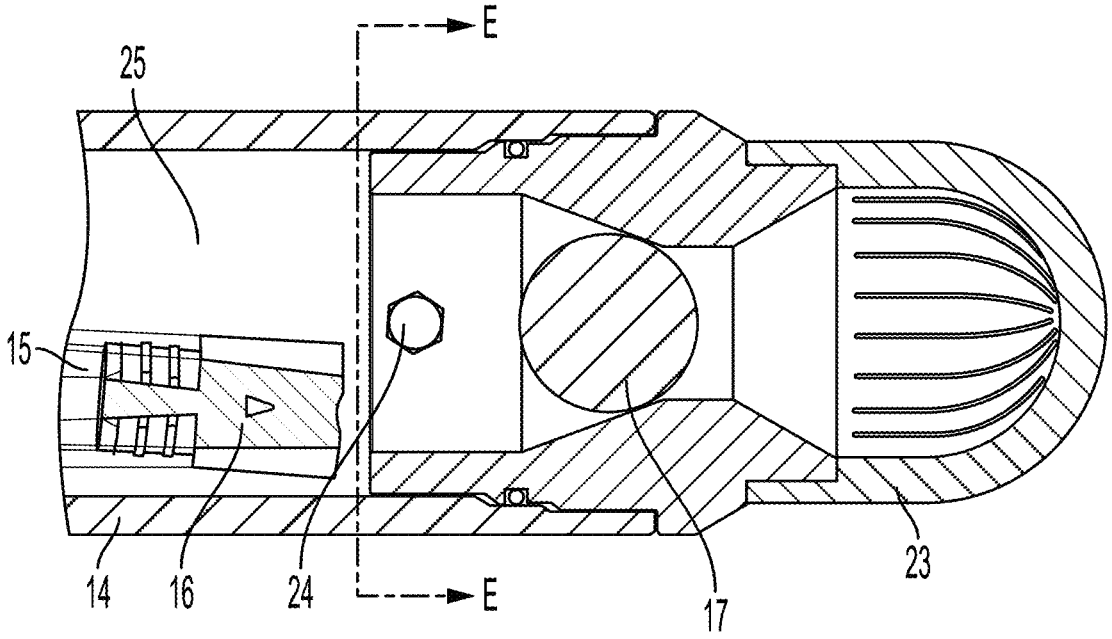
FIG. 14A illustrates a cutaway view of the distal portion of the pump illustrated in FIG. 10, along section B-B.
Figure 14B:
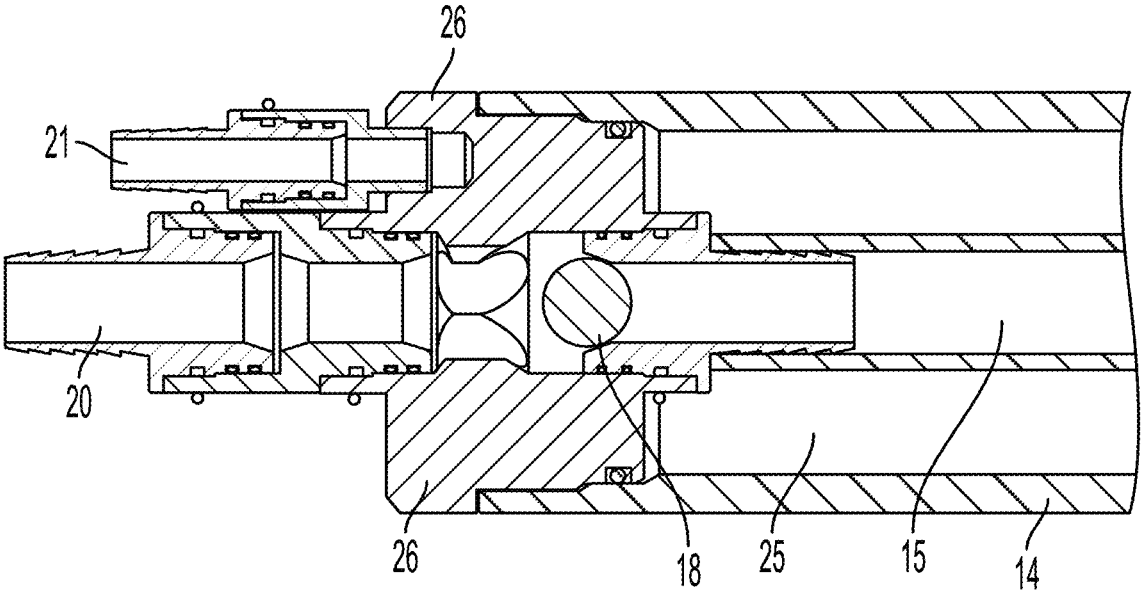
FIG. 14B illustrates a cutaway view of the proximal portion of the pump illustrated in FIG. 10, along section A-A

FIG. 13 illustrates a representative top view of the proximal portion of the pump 22 illustrated in FIG. 10, with section lines A-A taken through the gas inlet port and liquid/leachate exhaust port; and B-B taken along a representative centerline to illustrate the distal liquid/leachate inlet portion; both views visible in FIGS. 14A and 14B. Also shown are representative eye bolts or lifting ring attachments 28 used to lower and raise the pump 22 into a wellbore.

FIG. 14A illustrates a cutaway view of the distal portion of the pump 22 illustrated in FIG. 10, along section B-B. Shown therein are the representative casing 14, the bull nose liquid/leachate inlet 23, the one-way inlet check valve 17, the protrusions, shown as cap nuts 24, to provide a maximum opening for the inlet check valve 17, the distal portion of the fill cavity 25, the (flexed) end of the free-hanging discharge tube 15 laying along the inner wall of the fill cavity 25 and its weighted inlet nozzle 16 in close proximity to the proximal portion of the inlet check valve 17.

FIG. 14B illustrates a cutaway view of the proximal portion of the pump illustrated in FIG. 10, along section A-A. Shown therein are the representative casing 14, the proximal end of the free-hanging discharge tube 15 in the fill cavity 25 operably connected to the inlet portion of the discharge check valve 18, within the proximal endcap 26 which is operably connected to the liquid/leachate exhaust port of the fluid outlet discharge line 20. Also shown therein is the inlet portion of the gas inlet/vent line operably connected to the proximal endcap 26 adjacent to the liquid/leachate exhaust port of the fluid outlet discharge line 20.

Figure 14C:
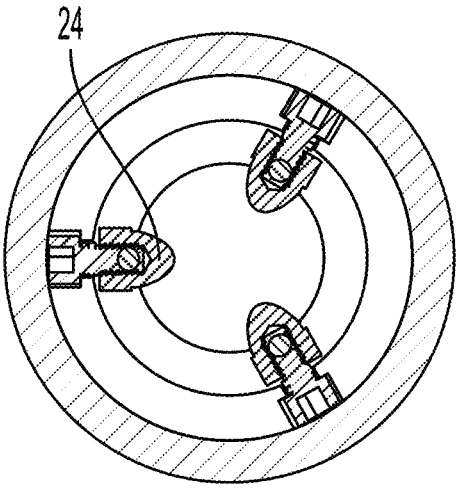
FIG. 14C illustrates a bottom view of the distal portion of the representative pump for improved visibility of an inlet check valve, along section E-E.

FIG. 14C illustrates a bottom view of the distal portion of the representative pump for improved visibility of an inlet check valve, along section E-E. Shown therein are representative placements of the protrusions, shown as cap nuts 24, to provide a maximum opening for the inlet check valve 17.

Figure 15A:
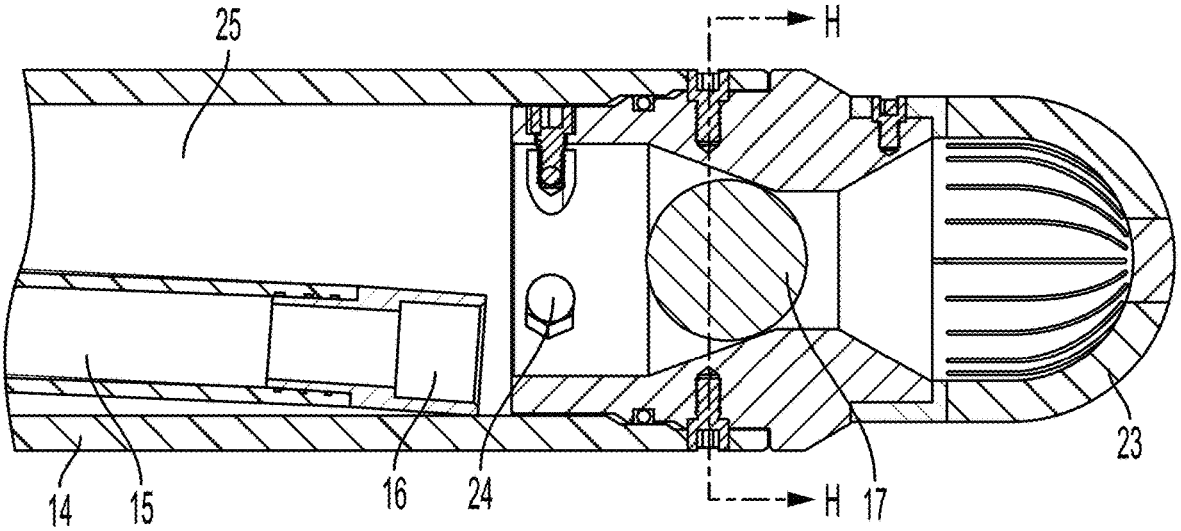
FIG. 15A is an illustrative detail cross-section view of the distal end of the pump showing detail features of the inlet check valve, pump body and assembly features.

FIG. 15A is an illustrative detail cross-section view of the distal end of the pump showing detail features of the inlet check valve, pump body and assembly features of the socket head cap screws taken along section H-H, used in the assembly of the inlet check valve 17 to the pump casing 14.

Figure 15B:
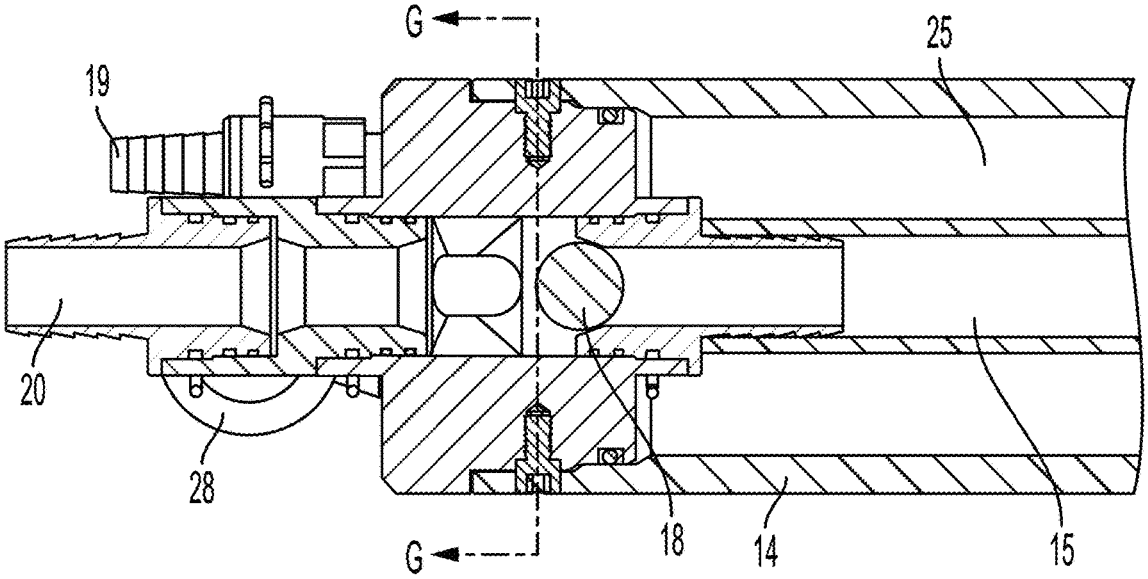
FIG. 15B is an illustrative detail cross-section view of the proximal end of the pump showing detail features of the exhaust check valve, pump body and assembly features.

FIG. 15B is an illustrative detail cross-section view of the proximal end of the pump showing detail features of the exhaust check valve, pump body and assembly features of the socket head cap screws taken along section G-G, used in the assembly of the proximal endcap 26 and exhaust check valve 18 to the pump casing 14.

Figure 15C:
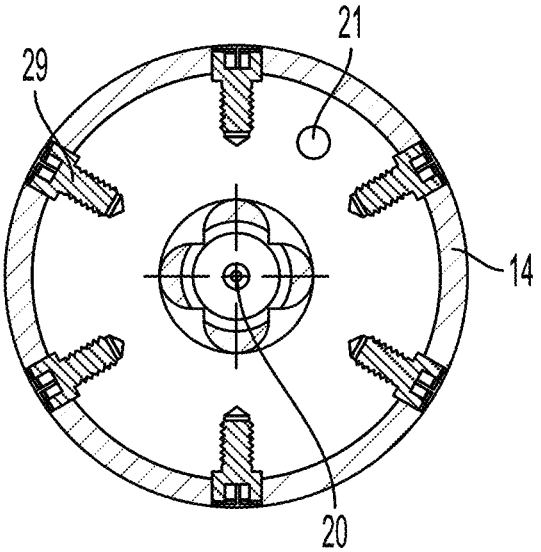
FIG. 15C is an illustrative detail cross-section view of the proximal end of the pump showing detail features of the exhaust check valve, pump body and assembly features, along section G-G.

FIG. 15C is an illustrative detail cross-section view G-G of the proximal end of the pump showing detail features through the exhaust check valve 18, the exhaust port, the bi-directional gas inlet/vent line 21, the pump casing 14 and assembly features of the socket head cap screws 29 taken, along section G-G.

Figure 15D:
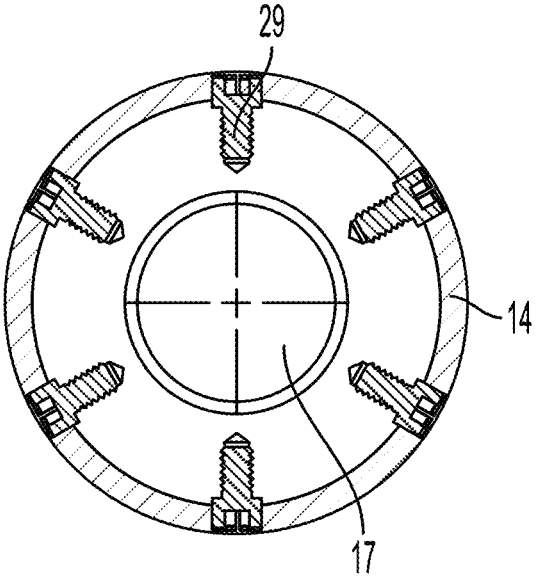
FIG. 15D is an illustrative detail cross-section view of the distal end of the pump showing detail features of the inlet check valve, pump body and assembly features, along section H-H.

FIG. 15D is an illustrative detail cross-section view H-H of the distal end of the pump showing detail features of the inlet check ball valve 17, pump body and assembly features 29, along section H-H.

Figure 16:
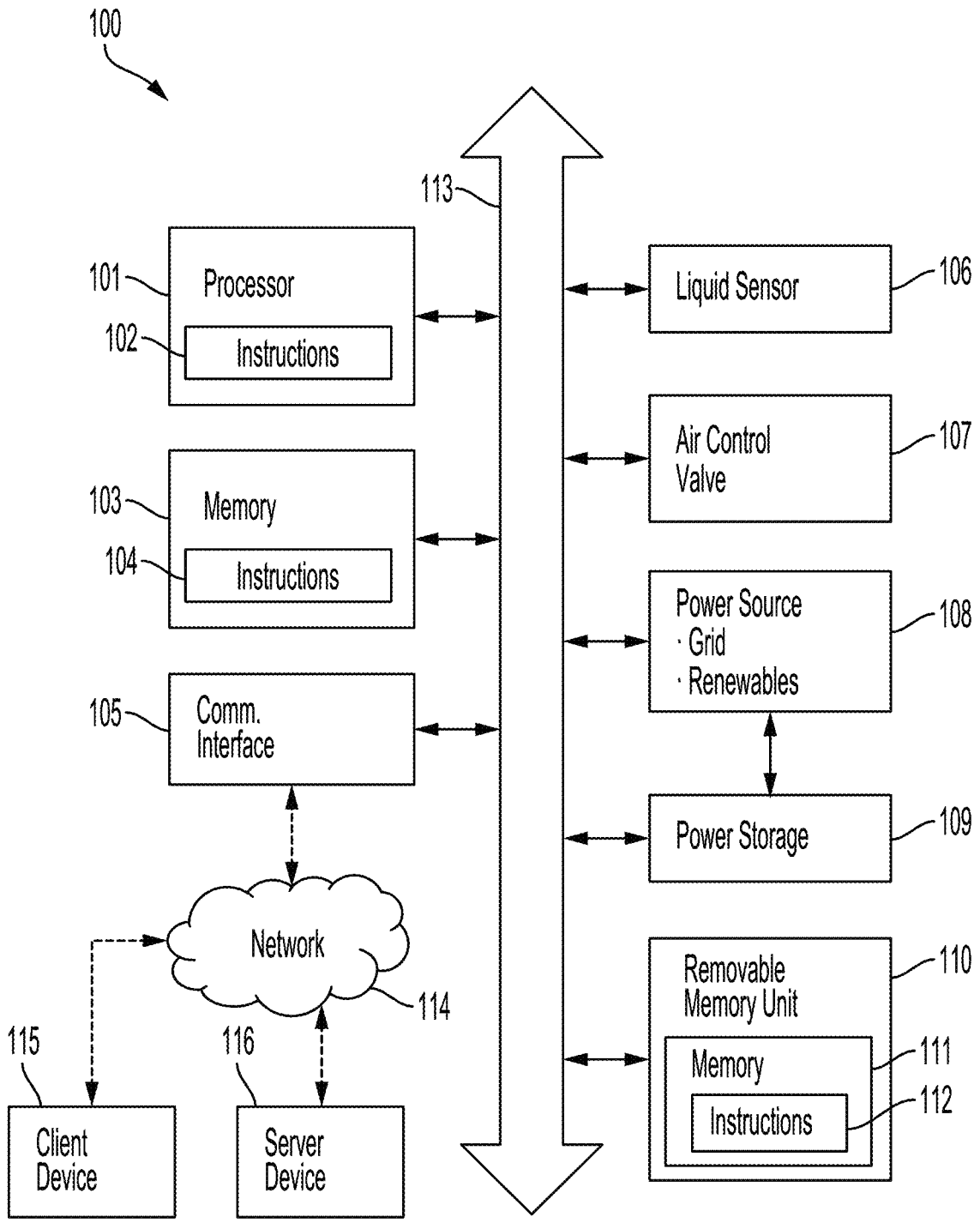
FIG. 16 is an illustrative diagram of features and components of a representative control system according to the present disclosure.

As shown in FIG. 16 is a representative graphic embodiment of a digital control system (9), 100 for the submersible floatless pneumatic fluid pump system 6 configured to execute computer-readable instructions (i.e., software and/or firmware; executable logic) stored on at least one non-transitory computer-readable medium.

A control system 100 includes a computer processor 101 that is configurable by a set of processor instructions 102, which may define an architecture or set of rules for the processor 101. The processor 101 is configured to execute computer-readable instructions 104 stored on a suitable memory, such as a non-transitory computer-readable medium 103. When the instructions 104 are executed by the processor 101, the processor 101 initiates and coordinates a procedure, such as a test procedure, a purge procedure, and/or a standby procedure, to control and/or monitor the pump system.

In at least some embodiments, a removable memory unit 110, such as a removable disc or other unit comprising a non-transitory computer-readable storage medium 111 with computer-readable instructions 112 thereon, may be temporarily used with the processor 101 of the control system 100 for any of a variety of reasons, including but not limited to execution of an alternate or temporary set of instructions.

Further, each embodiment comprises a liquid sensor 106, (11) and an air control valve 107, (19) among other components (i.e.: vent, 10), as applicable, and are operably connected to the processor 101 by hardware and/or electronic circuitry, which may include a bus 113. A power source 108 may be used to power the control system 100 and/or the pump system and/or the pump device. The power source 108 may include an electrical connection to a power grid for alternating current (AC; e.g., 120/220 VAC), and/or may include or utilize a renewable energy source, (such as solar power/solar cells, wind power, hydroelectric power, pneumatic turbine, in addition to other renewable energy sources (i.e.: geothermal), etc.

In at least some embodiments, a power storage 109, such as a rechargeable battery, may be included in the control system 100, which may be recharged by electricity obtained from the power source 108 and/or generated by an on-board alternate power source, such as a pneumatic turbine (8), local solar, wind, or hydroelectric power source. In various embodiments, electricity obtained from rotational movement of at least one pneumatic turbine (see pneumatic turbine 8 of FIGS. 2, 3, 4, 7 and 9) positioned in line with the source of pressurized air (7) may be used as a power source and/or to recharge the rechargeable battery. In at least some embodiment, as shown in FIG. 2, an additional auxiliary pneumatic turbine 8 could also be utilized in the auxiliary pneumatic bi-directional inlet control valve/vent line 21B as an additional power source to recharge the rechargeable battery. In at least some embodiments, electricity obtained from rotational movement of at least one liquid turbine (not shown) positioned in line with the liquid discharge (see liquid discharge 20 of FIGS. 2, 3, 4, 7 and 9) may be used as a power source and/or to recharge the rechargeable battery. In some embodiments, electricity obtained from rotational movement of an additional auxiliary liquid turbine (not shown) positioned in line with the original liquid discharge 20 or an additional auxiliary liquid discharge (not shown) could also be configured.

Accordingly, while the systems and devices of the present disclosure may be powered by a power grid, in at least some circumstances, it may be beneficial to utilize a renewable power source at the site of use. For example, a solar panel may be positioned in relative proximity to one or more submersible floatless pneumatic pump devices 22 and used to power the pump devices and/or control systems 6. In this manner, the systems and devices may be more robust and may be operationally maintained regardless of the status of the power grid.

In various embodiments, elements of the control system 100 may present as, and may operate as, a standalone device or may include a device that can be connected (e.g., networked) to other devices for data exchange. In a networked deployment, a server device 116 and/or a client device 115 in a server-client network environment may be used to store and/or execute and/or transmit data and/or instructions to and/or from each other and/or other devices. Alternatively, elements of the control system 100 may be configured as a peer device in a peer-to-peer (or distributed) network environment.

A device of the control system 100 can be a server, a smartphone or cellular telephone, a tablet, a personal computer (PC), a set-top box (STB), a personal digital assistant (PDA), a web appliance, a network router, switch, or bridge, or any device capable of executing instructions (sequential or otherwise) that specify actions to be taken by that device. Further, the term "device" shall be taken to include one device or, alternatively, any collection of devices that individually or jointly execute a set (or multiple sets) of instructions to perform any one or more of the methodologies discussed herein.

The example control system 100 includes a processor 101 (e.g., a central processing unit (CPU) or microprocessor unit (MCU)), a graphics processing unit (GPU), or both), a main memory 103, and may include a static memory, which communicate with each other via a bus 113. The control system 100 may include an audio-video output (not shown; e.g., a video display; e.g., a liquid crystal display (LCD) or a cathode ray tube (CRT)). The control system 100 may include an input device (not shown; e.g., a keyboard or a touch-sensitive display screen) and/or a user interface (UI) navigation (or cursor control) device (e.g., a mouse), a removable memory unit 110 (e.g., a disk drive unit), a signal generation device (e.g., a speaker), and a communication interface which may be in the form of a network interface device 105.

The memory 103 includes a non-transitory computer-readable medium on which are stored one or more sets of data structures and instructions 104 (e.g., software) embodying or utilized by any one or more of the methodologies or functions described herein. The instructions 104 may also reside within the processor 101 and/or within the memory 103, e.g., during execution thereof, with the memory 103 and the processor 101 also constituting non-transitory machine-readable media.

While the computer-readable medium 103 is shown in an example embodiment to be a single medium, this may include a single medium or multiple media (e.g., a centralized or distributed database, and/or associated caches and servers) that store the one or more instructions 102 and/or 104, and/or data structures.

"Memory" and "medium", and the like, may include any tangible medium that is capable of storing, encoding, or carrying instructions 104 for execution by the processor 101 and that cause the processor to perform any one or more of the methodologies of the present disclosure, or that is capable of storing, encoding, or carrying data structures utilized by or associated with such instructions.

The term "computer-readable medium" shall accordingly be taken to include, but not be limited to, solid-state memories, and optical and magnetic media. Specific examples of computer-readable media include non-volatile memory, including by way of non-limiting example; semiconductor memory devices, e.g., erasable programmable read-only memory (EPROM), electrically erasable programmable read-only memory (EEPROM), and flash memory devices; magnetic disks such as internal hard disks and removable disks; magneto-optical disks; and CD-ROM and DVD-ROM disks.

The instructions (102/104/112) can be transmitted or received over a communication network 114 using a transmission medium. The instructions can be transmitted using the network interface device 105 and any of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Bluetooth, BLE (low energy Bluetooth), Zigbee, Wi-Fi and WiMax networks, a Low Power, Wide Area (LPWA) networking protocol, e.g., LoRa and/or LoRaWAN, etc.).

The term "transmission medium" shall be taken to include any intangible medium that is capable of storing, encoding, or carrying instructions for execution by the computer, and includes digital or analog communications signals or other intangible media to facilitate communication of such software.

An electronic controller device 100 may comprise the processor 101 and instructions 102, the memory 103 and instructions 104 and, if appropriate, the communication interface 105, which will allow users to control the pump device using a client device 115 such as a cell phone, a tablet, or a PC. The electronic controller device may broadcast a local hotspot network, e.g., via the communication interface 105 or via a separate wireless transceiver, which the client device 115 and/or the server device 116 may connect to. Upon connection, the device may be directed to a webpage hosted by the electronic controller device that allows the user to view a cycle counter (e.g., total number of pump cycles within a period), sleep time (e.g., total time the pump device is or was or will be in standby mode), purge time (e.g., total time the pump device is or was or will be in purge mode) and fill times (e.g., time or number of negative test procedures between any two or more positive test procedures and/or purge procedures). The user may utilize the client device to adjust parameters of the electronic controller device, thereby controlling and/or monitoring the pump device, via the broadcasted webpage. Since the webpage is displayed by a browser of the client device, integration of the client device with the electronic controller device is achieved without necessarily needing the user to download an "app" or dedicated software application for use.

A data acquisition (DAQ) module (not shown) may be included as a separate or optional device or an optional or activatable feature of the electronic controller device that enables monitoring of other aspects related to performance of the pump device. The DAQ may enable measurement of compressed air pressure, vacuum pressure and/or temperature, liquid pressure and/or temperature, liquid flow, vacuum, gas flow, subterranean pressures and temperatures (i.e.: landfill at the depth of the pump), etc.

The server may include a Structured Query Language (SQL) based server storage system (not shown) configured to receive, store, analyze and/or provide data acquired by one or more pump devices. The server database may be operably linked to a webpage API which allows users to 1) login to the database and view historical and/or current data of any pump the user has permission to view; 2) control and monitor any pump device the user as permission to control and monitor; and 3) add pump devices to a company profile or account according to computer-based access permission rules. System parameters such as fill time, purge time, sleep time and data acquisition sampling rates may be updated remotely, and all data collected by the pump device may be transmitted to the server using the cell module.

In any number of embodiments, the configuration of features and working specifications may be varied. In an illustrative embodiment of the submersible floatless pneumatic pump system 6, actuation of the example pump device 22 is achieved through use of one or more central processing units (CPUs); however, other actuation means are envisioned without departing from the scope of the disclosure.

In an exemplary embodiment, the microcontroller (MCU) 101 used is an ESP32 manufactured by Espressif. However, any microcontroller, DSP or computer can accomplish this task. The ESP32 is a 32 bit processor, but an 8 bit, 16 bit, 32 bit or 64 bit processor can accomplish this task. The job of the microcontroller is to control the pressurized gas value 19 to provide pressurized air 7 to the pump 22 or to allow the pump to vent 10 through the bi-directional gas line 21 while liquid/leachate 30 is entering the pump. When the MCU, directs pressurized air into the pump, the MCU will monitor the liquid sensor 11 to determine if any liquid is in the fluid outlet discharge line 20 indicating the pump was full. This is the basic operation of the MCU.

Additional features utilized by the exemplary embodiment in the MCU 101 are as follows:

a. WIFI communication 105 with a user though a web portal via a network 114. The user can connect their phone or laptop 115 to the WIFI hotpot provided by the MCU. When the user connects with the MCU, a series of webpages are used to provide a user interface where the user can adjust a multitude of features. These include fill time, purge time, sleep time, battery voltage under lockout and recovery, set date/time, solenoid drive time for switching the air valve, etc.

b. The MCU 101 can also measure several system diagnostics and records these to an SD card 110 along with the results of pump operation. The diagnostics include: battery voltage, solar panel voltage, battery charging/discharging current, PCB temperature, humidity, air pressure, pump pressure, forced main pressure, subterranean pressures and temperatures (i.e.: landfill at the depth of the pump), etc.

In an exemplary embodiment, the pump device 22 is bottom-loading and may be configured for a high-temperature operational environment.

The illustrative pump device includes a 3.5 in. outer diameter, a 42.75 in. length, a 17.25 lb. weight, a 0.80 gal./stroke, an actuation point that is 4.0 in. from the bottom of the pump device, and an air pressure range of 5-250 psi. The pressure rating is 500 psi. and the tensile strength is 2650 lbf. It should be understood that the described engineering specifications are examples, and other engineering specifications may be used or referenced to make and use a submersible floatless pneumatic pump device, particularly, a floatless pump device, and/or a floatless pump system, according to the disclosure. These specifications are for example only, and other specifications for a pump device are envisioned without departing from the scope of the present disclosure. In various embodiments, one or more of these or other physical properties or performance characteristics may vary by about ±1% from the example given, about ±2% from the example given, about ±3% from the example given, about +4% from the example given, about ±5% from the example given, about ±6% from the example given, about ±7% from the example given, about ±8% from the example given, about +9% from the example given, about ±10% from the example given, about ±15% from the example given, about ±20% from the example given, about ±25% from the example given, about ±30% from the example given, about ±35% from the example given, about ±40% from the example given, about +45% from the example given, about ±50% from the example given, or more.

Figure 17A:
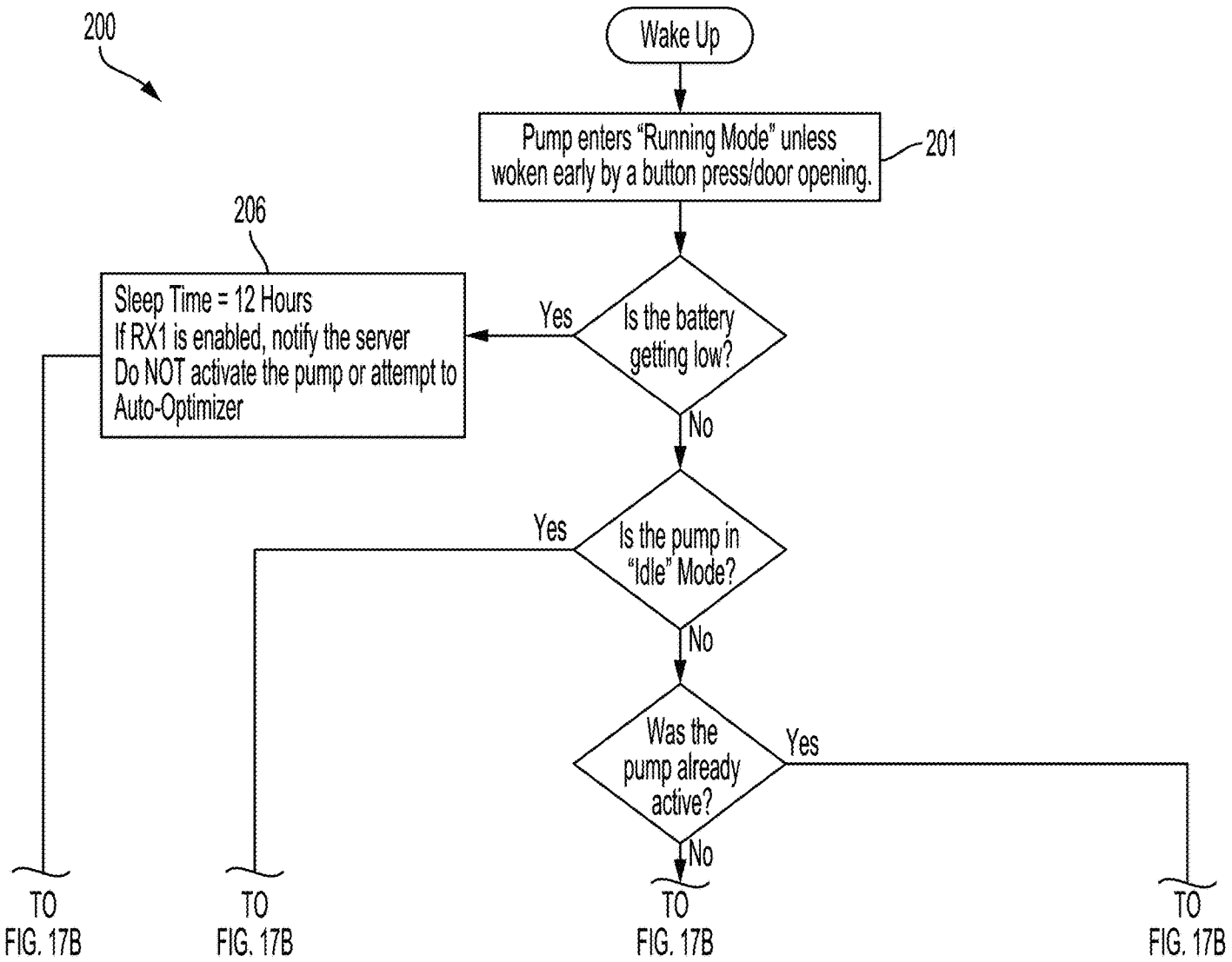
FIGS. 17A & 17-B is an illustrative logic flow diagram of the floatless pneumatic leachate pump control system according to the present disclosure.
Figure 17B:
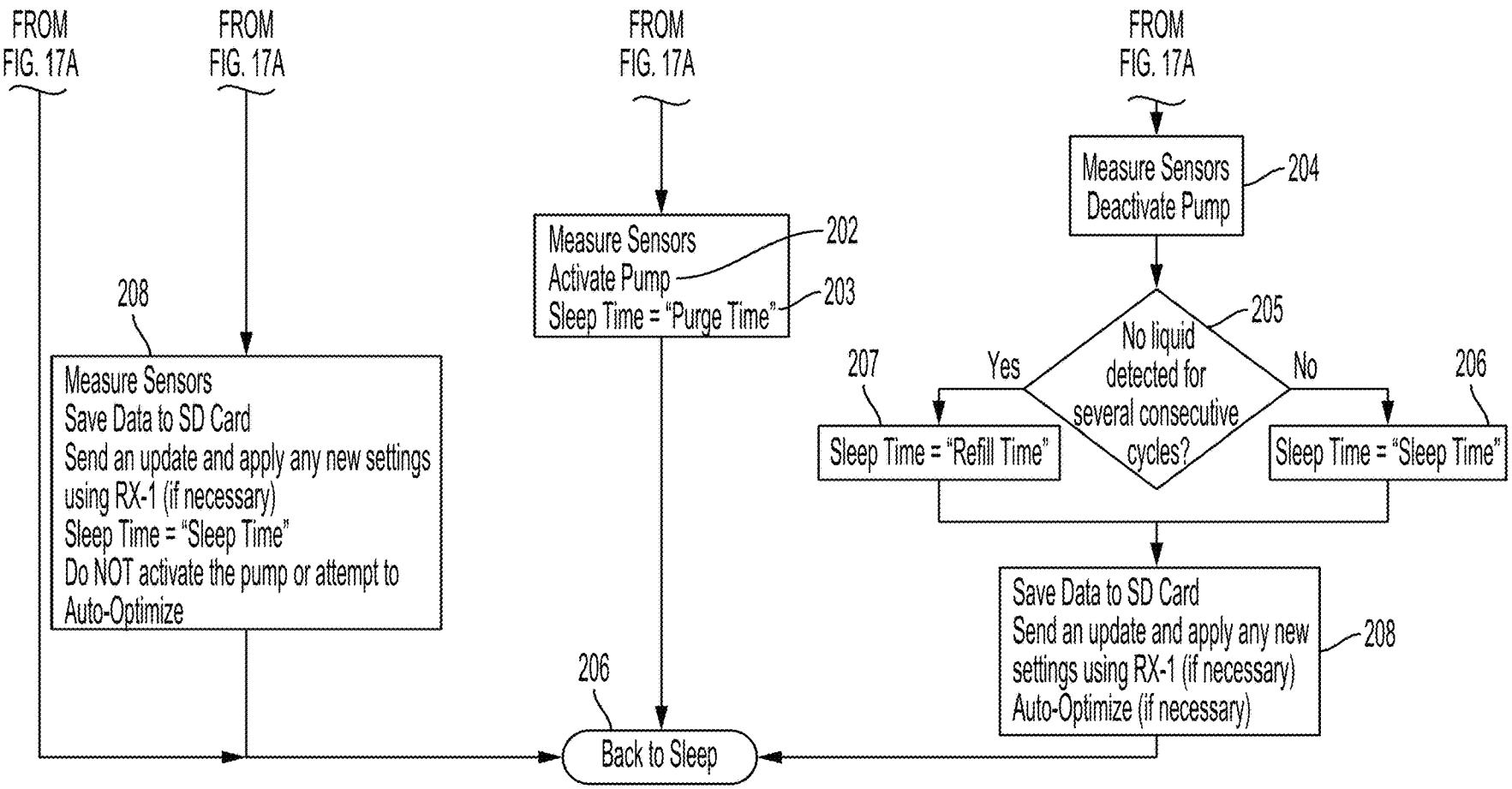

FIGS. 17-A & 17-B is an illustrative logic flow diagram 200 of the "Running Mode" or default instructions 102/104 utilized by the electronic processor 101 for the floatless pneumatic leachate pump control system 6 according to the present disclosure.

In a typical pumping cycle for the illustrative running mode, a control system 100 is configured to execute a test procedure (method) 201 of the pump system to attempt to detect a liquid at the liquid sensor 106 (11) of the pump system. If the liquid is detected, a purge procedure 202 of the pump system may be executed to purge the liquid from the pump device. If the liquid is not detected, a standby procedure 204 of the pump system may be executed to cause the system to wait 203 and allow liquid, if present in the bore 13, to enter the pump 22 from the bore.

Said another way a typical pumping cycle for the illustrative running mode may comprise: a first "Purge" step of applying compressed air to the pump for a given time, forcing accumulated fluid to be forced up the exit line to the surface. After said Purge time has elapsed, the processor will collect measurements and check for fluid near the exit with a fluid sensor before disabling the compressed air supply for a rest or sleep cycle.

a. If water was . . .

i. Present: The well had enough fluid to completely refill the pump, so it will wait for a Fill Time before running another compressed air cycle for an additional purge time.

ii. Absent: The well is dry and needs more time to refill, so it can wait for a longer Sleep Time before running another compressed air cycle for an additional purge time.

The procedure (method) 200 includes connecting 202 compressed air (7) to the pump device; waiting 203 according to a purge time; and disconnecting 204 the compressed air from the pump device. At that point, the liquid/leachate sensor 106, (11), detects or does not detect liquid 205 at the outlet of the pump device (12). If liquid is detected (step 207: YES), then the system waits according to a fill time 207 to allow the pump to refill and repeat another pump cycle. If liquid is not detected (step 206: NO), then the system waits according to a sleep time 206 to allow the liquid to enter the pump before another test procedure is initiated. After each of data collection steps 201, 206 and 207 is completed, data is saved and stored 208 to a removeable memory unit (e.g.: SD card) where it can later be transmitted to a server device 116 or client device 115 via the established network 114.

Accordingly, in embodiments, the test procedure method configures the one or more processors and/or the hardware circuitry to connect a source of pressurized gas to a fill cavity of the pump device of the pump system, wait based on a purge time, and determine, based on a result of a sensor of the pump system, whether the liquid is detected. The purge procedure configures the one or more processors and/or the hardware circuitry to connect the source of pressurized gas to the fill cavity of the pump device of the pump system and wait based on the purge time (i.e., "fill time"), and the standby procedure configures the one or more processors and/or the hardware circuitry to wait based on a wait time (i.e., "sleep time").

In another aspect, a method of regulating levels of liquid leachate in a landfill wellbore with a floatless pneumatic fluid pump is described: The method comprising the use of a floatless pneumatic fluid pump 22 comprising, a pump casing 14 with a proximal end cap 26 and distal inlet end 23, extending along an axis Y-Y and at least partially defining an interior of the fluid pump, a 3-way pneumatic inlet control valve/vent valve 19 with attached vent 10 operably connected to a pressurized gas source 7 via a bi-directional gas inlet/vent line 21 to an internal fill cavity 25; a free-hanging discharge tube 15 within the internal fill cavity 25 disposed between an inlet check valve 17 and a discharge check valve 18; a fluid outlet discharge line 20 having a discharge outlet 12, and a liquid sensor 11 positioned along the fluid outlet discharge line 20 prior to the discharge outlet 12; The method comprising: inserting said floatless pneumatic fluid pump 22 in the landfill wellbore 13; allowing liquid/leachate 30 to enter and accumulate in the fill cavity through the distal inlet end 23 and inlet check valve 17; actuating the pneumatic inlet control valve/vent valve 19 to allow pressurized gas 7 to enter and pressurize the internal fill cavity 25 through the bi-directional gas inlet/vent line 21; causing said inlet check valve 17 to close and discharge check valve 18 to open; forcing said accumulated liquid/leachate 30 in the fill cavity 25 to enter a distal end 16 of the free-hanging discharge tube 15 and pass through said discharge check valve 18, into said discharge line 20, said discharged liquid/leachate 30, passing a liquid sensor 11 prior to reaching the discharge outlet 12; deactivating the pneumatic inlet control valve/vent valve 19 to stop the flow of pressurized gas 7 into the fill cavity 25; opening the vent 10 to allow the pressurized gas 7 in the fill cavity 25 to exhaust to atmosphere through the bi-directional gas inlet/vent line 21; causing said discharge valve 18 to close and said inlet check valve 17 to open; and once again allowing liquid/leachate 30 to enter and accumulate in the fill cavity 25 through distal inlet end 23 and the inlet check valve 17.

In some embodiments of the method, additional sensors monitor atmospheric and subterranean pressure within the pump, wherein said data is reported out to and recorded by a control system for said pump.

In some embodiments of the method, additional sensors monitor either the presence of, or amount of liquid within the pump, wherein said data is reported out to and recorded by a control system for said pump.

In another aspect, a method of regulating fluid levels in a well, sump, sufficiently deep pond or pool with a floatless pneumatic fluid pump and control system is described, the floatless pneumatic fluid pump comprising a pump casing with a proximal and distal end, extending along an axis and at least partially defining an interior of the fluid pump, a pneumatic inlet control valve/vent valve with vent operably connected to a pressurized gas source via a gas inlet/vent line to an internal fill cavity; a free-hanging discharge tube within the internal fill cavity disposed between an inlet check valve and a discharge check valve; a fluid outlet discharge line having a discharge outlet, and a liquid sensor positioned along the fluid outlet discharge line prior to the discharge outlet, the method comprising: sensing for the presence of a predetermined amount of fluid in the fluid outlet discharge line with the liquid sensor and wherein if said predetermined amount of fluid is present in the discharge line; pressurizing the internal fill cavity to purge said fluid via the gas inlet/vent line by activating said pneumatic inlet control valve/vent valve operably connected to the pressurized gas source; causing said inlet check valve to close and said discharge valve to open; forcing said accumulated liquid in the fill cavity to enter a distal end of the free-hanging discharge tube and pass through said open discharge check valve, into said discharge line, said discharged liquid, passing the liquid sensor prior to reaching the discharge outlet; maintaining said pressurized gas source flow until less than the predetermined amount of fluid level is detected by the fluid sensor; deactivating the pneumatic inlet control valve/vent valve to stop the flow of pressurized gas into the fill cavity; opening the vent to allow pressurized gas in the fill cavity to exhaust to atmosphere through the gas inlet/vent line; causing said discharge valve to close and said inlet check valve to open; allowing liquid to enter and accumulate in the fill cavity through the open inlet check valve.

In some embodiments, the method, further comprising: using an automated electronic controller to monitor and instruct said fluid pump components to activate and deactivate utilizing control loop programs; wherein pressurized pumping continues for a set period of time, a number of cycles, or until at least a minimum desired value of fluid is detected, and wherein if less than the predetermined amount of fluid level is detected in the discharge line by the liquid sensor, said control loop program will instruct said fluid pump to go into a timed standby mode and wait a period of time before performing another test purge, thus repeating the cycle.

In another aspect, a floatless pneumatic fluid pump apparatus suitable for use in a non-landfill applications is described; the fluid pump comprising: a pump casing having a proximal and distal end extending along an axis and at least partially defining an interior of the fluid pump, a proximal endcap, a fluid inlet, a fluid outlet, a gas inlet/vent line, a fill cavity within the pump casing, a fluid outlet discharge line operably connected to the proximal endcap and the fluid outlet, an inlet check valve within the distal end of the pump casing disposed between the fluid inlet and the fill cavity, and configured to allow one-way passage of liquid into the fill cavity, a discharge check valve configured to prevent discharged liquid from returning to the fill cavity, a free-hanging discharge tube within the fill cavity, and disposed between the inlet check valve and operably connected to the discharge check valve, a pneumatic inlet control valve/vent valve, operable connected to the proximal endcap and a pressurized gas source with the gas inlet/vent line and configured to introduce pressurized gas to the interior of the fluid pump and vent pressurized gas from the interior of the fluid pump and a liquid sensor positioned along the fluid outlet discharge line prior to the discharge outlet, configured to sense the presence of liquid in the fluid outlet discharge line and actuate the pneumatic inlet control valve/vent valve.

In most embodiments of the floatless pneumatic pump apparatus, said pump does not comprise a float switch or fluid float and is further configurable for various applications involving sufficiently deep ponds, holding ponds, filtration ponds or pools to allow for transfer to holding tanks or other ponds and pools.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A submersible floatless pneumatic fluid pump system for use in a landfill well bore, the fluid pump system comprising:

a control system having processors comprising a CPU, and a GPU, or a MCU and a GPU;

a floatless pneumatic fluid pump comprising a pump casing with a proximal and distal end, extending along an axis and at least partially defining an interior of said floatless pneumatic fluid pump;

a pneumatic inlet control valve/vent valve operably connected to a pressurized gas source and to a proximal endcap on the pump casing via a gas inlet/vent line operably connected with an internal fill cavity;

a fluid inlet on the distal end of the pump casing;

an inlet check valve at the distal end of the pump casing, disposed between the fluid inlet and the internal fill cavity of the interior of the floatless pneumatic fluid pump;

a discharge check valve in the proximal end of the pump casing distal to the proximal endcap;

a fluid outlet discharge line having a discharge outlet and a distal end operatively connected to the proximal endcap of the pump casing and operably connected to the discharge check valve; and a free-hanging discharge tube within the pump casing, disposed within the fill cavity, operably connected proximally to the discharge check valve and flexibly moveable within the fill cavity;

wherein the fluid inlet is configured to allow liquid/leachate to enter the floatless pneumatic fluid pump below the inlet check valve, wherein the inlet check valve is configured to allow one way passage of the liquid/leachate into the fill cavity and prevent said liquid/leachate from returning to the well bore, wherein the pneumatic inlet control valve/vent valve controls a flow of pressurized gas to the fill cavity to force liquid/leachate into a distal end of the free-hanging discharge tube, and up to the discharge check valve, and wherein said discharge check valve operably serves to connect to the fluid outlet discharge line and prevent discharged liquid/leachate from returning to the fill cavity.

2. The floatless pneumatic fluid pump system of claim 1, wherein said floatless pneumatic fluid pump is configurable for vertical, non-linear and deviated well applications.

3. The floatless pneumatic fluid pump system of claim 1, further comprising:

a liquid sensor, located proximal to and outside of the floatless pneumatic fluid pump along the fluid outlet discharge line.

4. The floatless pneumatic fluid pump system of claim 3, wherein the liquid sensor is external to the floatless pneumatic fluid pump and accessible at grade level, without the need to remove the floatless pneumatic fluid pump from the well bore.

5. The floatless pneumatic fluid pump system of claim 3, wherein the liquid sensor comprises:

an optical sensor; or a resistive sensor; or a capacitive sensor; or an ultrasonic sensor; or a photoelectric sensor; or a combination thereof.

6. The floatless pneumatic fluid pump system of claim 1, wherein the flexibly moveable free-hanging discharge tube is stationary, bent or curved.

7. The floatless pneumatic fluid pump system of claim 6, wherein said flexibly moveable free-hanging discharge tube further comprises a weighted inlet nozzle that encourages the end of the discharge tube to lay in the lowest possible portion of the fill cavity.

8. The floatless pneumatic fluid pump system of claim 1, further comprising:

a gas vent line operably connected to said pneumatic inlet control valve/vent valve, configured to release and vent the pressurized gas out of the fill cavity and cease a push transfer of the accumulated liquid/leachate from the fill cavity.

9. The floatless pneumatic fluid pump system of claim 1, further comprising:

a pneumatic turbine provided in line with the source of pressurized gas and configured to provide either a primary or an alternate source of power.

10. The floatless pneumatic fluid pump system of claim 1, wherein the distal portion of the pump casing further comprises an expanded portion below a narrower proximal portion of the pump casing to effectively increase the capacity of the fill cavity.

11. The floatless pneumatic fluid pump system of claim 10, wherein said free-hanging discharge tube further comprises a weighted inlet nozzle and is flexibly moveable within the expanded portion of the fill cavity.

12. The floatless pneumatic fluid pump system of claim 1, wherein the entire pump casing is flexible, insertable and operable in a well bore that is non-linear or deviated.

13. The floatless pneumatic fluid pump system of claim 1, wherein said control system is configured to monitor and/or control pump cycles.

14. The floatless pneumatic fluid pump system of claim 13, wherein said control system comprises:

a power source;

processors comprising said CPU and GPU, or said MCU and GPU;

a liquid sensor;

one or more additional sensors;

memory storage for data collection of the floatless pneumatic fluid pump function; and one or more transmitters and one or more receivers;

wherein said power source comprises:

an electrical power grid; or batteries; or a solar cell; or a pneumatic turbine; or a combination thereof;

wherein said CPU and GPU or said MCU and GPU are configured to execute computer-readable instructions stored on at least one non-transitory computer-readable medium comprising test procedures including a control loop, wherein said one or more additional sensors comprise:

an air pressure sensor; or a conductive digital sensor; or an ambient temperature sensor; or a solar sensor; or a battery voltage sensor or monitor;

or a combination thereof within the system;

wherein said memory storage comprises non-transitory computer readable medium, wherein said one or more transmitters are configured to transmit stored data from memory storage to a remote device directly via direct connections or between client devices and controller devices or indirectly via indirect connections, and wherein said one or more receivers are configured to receive control instructions from client devices.

15. The floatless pneumatic fluid pump system of claim 14, further comprising:

one or more server devices for:

remotely controlling and monitoring the pump apparatus; or transmission of pump apparatus operation data or instructions.

16. The floatless pneumatic fluid pump system of claim 14, wherein said CPU and GPU or said MCU and GPU is configured with the control loop configured to perform periodic test purges to determine if liquid/leachate is present in the discharge line, as evidenced by the liquid sensor, wherein if liquid/leachate is present in the discharge line, said CPU and GPU or said MCU and GPU will instruct said floatless pneumatic fluid pump to activate and continue pumping for a set period of time, a number of cycles, or until at least a minimum desired value of liquid/leachate is detected, and wherein if less than the minimum desired value of liquid/leachate is detected in the discharge line, said control loop will instruct said floatless pneumatic fluid pump to go into a timed standby mode and wait a period of time before performing another test purge, thus repeating the cycle.

17. The floatless pneumatic fluid pump system of claim 16, whereby said control loop activates a purge cycle by causing said pneumatic inlet control valve/vent valve to open and inject pressurized gas into the fill cavity of the floatless pneumatic fluid pump, thereby forcing accumulated liquid/leachate in the fill cavity into the free-hanging discharge tube, through the discharge check valve, out through the fluid outlet discharge line and past the liquid sensor to the discharge outlet.

18. The floatless pneumatic fluid pump system of claim 16, whereby said control loop activates a standby mode by causing said pneumatic inlet control valve/vent valve to close and causing said gas vent line to open, releasing pressurized gas from the fill cavity of the floatless pneumatic fluid pump, and allowing the pump fill cavity to fill through the inlet check valve until the standby mode times out.

19. The floatless pneumatic fluid pump system of claim 1, further comprising:

an auxiliary gas inlet/vent line, and an auxiliary pneumatic inlet control valve/vent valve with an auxiliary gas vent line, operably connected to the pressurized gas source, to facilitate rapid transfer of accumulated liquid/leachate from the fill cavity.

20. A floatless pneumatic fluid pump apparatus suitable for use in a landfill well, holding pond, filtration pond, oil well, water well or pool, the floatless pneumatic fluid pump apparatus comprising:

a floatless pneumatic fluid pump comprising;

a pump casing having a proximal and distal end extending along an axis and at least partially defining an interior of the floatless pneumatic fluid pump apparatus;

a proximal endcap;

a fluid inlet;

a liquid discharge;

a gas inlet/vent line;

a fill cavity within the pump casing;

a fluid outlet discharge line operably connected to the proximal endcap and the liquid discharge;

an inlet check valve within the distal end of the pump casing, disposed between the fluid inlet and the fill cavity and configured to allow one way passage of liquid/leachate into the fill cavity;

a discharge check valve configured to prevent discharged liquid/leachate from returning to the fill cavity;

a free-hanging discharge tube within the fill cavity, operably connected to the discharge check valve and is flexibly moveable within the fill cavity;

a pneumatic 3-way inlet control valve/vent valve, operably connected to the proximal endcap and to a pressurized gas source and to the gas inlet/vent line and configured to introduce pressurized gas into the interior of the floatless pneumatic fluid pump and to vent pressurized gas from the interior of the floatless pneumatic fluid pump; and a liquid sensor positioned along the fluid outlet discharge line prior to the liquid discharge configured to sense the presence of liquid/leachate in the fluid outlet discharge line and actuate the pneumatic 3-way inlet control valve/vent valve.

21. The floatless pneumatic fluid pump apparatus of claim 20, wherein said floatless pneumatic fluid pump is configurable for vertical, non-linear and deviated well applications.

22. The floatless pneumatic fluid pump apparatus of claim 20, wherein the flexibly moveable free-hanging discharge tube is stationary, bent, or curved.

23. The floatless pneumatic fluid pump system apparatus of claim 20, wherein said free-hanging discharge tube further comprises a weighted inlet nozzle.

24. The floatless pneumatic fluid pump apparatus of claim 20, further comprising a distal portion of the pump casing comprising an expanded portion below a narrower proximal portion to effectively increase the capacity of the fill cavity.

25. The floatless pneumatic fluid pump apparatus of claim 24, wherein said free-hanging discharge tube further comprises a weighted inlet nozzle and is flexibly moveable within the expanded portion of the fill cavity.

26. The floatless pneumatic fluid pump apparatus of claim 20, wherein the entire pump casing is flexible, insertable and operable in a well bore that is non-linear or deviated.

27. The floatless pneumatic fluid pump apparatus of claim 20, further comprising:

a pneumatic turbine provided in line between the source of pressurized gas and the floatless pneumatic fluid pump and configured to provide an alternate source of power.

28. The floatless pneumatic fluid pump apparatus of claim 20, further comprising:

an auxiliary bi-directional gas inlet/vent line;

an auxiliary pneumatic bi-directional inlet control valve/vent valve; and an auxiliary gas vent line;

operably connected to the pressurized gas source, to facilitate rapid transfer of accumulated liquid/leachate from the fill cavity.

29. The floatless pneumatic fluid pump apparatus of claim 28, further comprising:

an auxiliary pneumatic turbine provided in the auxiliary pneumatic bi-directional inlet control valve/vent line and configured to provide an alternate or additional source of power.

30. The floatless pneumatic fluid pump apparatus of claim 20, wherein the liquid sensor is positioned proximal to and outside of the floatless pneumatic fluid pump at grade level.

31. The floatless pneumatic fluid pump apparatus of claim 20, wherein the liquid sensor comprises:

an optical sensor; or a capacitive sensor; or a resistive sensor; or an ultrasonic sensor; or a photoelectric sensor;

or a combination thereof.

32. The floatless pneumatic fluid pump apparatus of claim 20, wherein the liquid sensor is configured to send input data to a control system regarding the detection of liquid/leachate in the fluid outlet discharge line, which in turn controls the function of the pneumatic 3-way inlet control valve/vent valve.

33. The floatless pneumatic fluid pump apparatus of claim 20, wherein the pneumatic 3-way inlet control valve/vent valve is operably connected to the gas inlet/vent line and is configured to release and vent the pressurized gas out of the fill cavity.

34. The floatless pneumatic fluid pump apparatus of claim 20, wherein said floatless pneumatic fluid pump apparatus is configured for remote operation by a control system comprising:

a power source;

a computer processor configured to execute computer-readable instructions;

memory systems comprising non-transitory computer readable medium;

a server;

an audio/video output;

an input device;

a signal generation device; and a communication interface;

wherein said control system is configured to monitor said floatless pneumatic fluid pump apparatus and execute multiple loop procedures comprising:

purge procedures;

standby procedures; and component test procedures.

35. The floatless pneumatic fluid pump apparatus of claim 34, wherein said control system receives data from the liquid sensor indicating the presence or absence of liquid/leachate in the fluid outlet discharge line, whereby the control system determines the need to activate one or more of the multiple loop procedures.

36. The floatless pneumatic fluid pump apparatus of claim 34, wherein the purge procedure comprises:

receiving data from the liquid sensor, indicating the existence of a known amount of liquid/leachate in the floatless pneumatic fluid pump apparatus;

opening the pneumatic 3-way inlet control valve/vent valve, allowing gas from the pressurized gas source to enter the fill cavity via the gas inlet/vent line, forcing accumulated liquid/leachate in the fill cavity to enter the free-hanging discharge tube, into and through the discharge check valve, into the fluid outlet discharge line, past the liquid sensor and out of the discharge outlet, until said accumulated liquid/leachate is evacuated from the floatless pneumatic pump apparatus;

closing the pneumatic 3-way inlet control valve/vent valve, allowing gas from the pressurized fill cavity to return to the pneumatic 3-way inlet control valve/vent valve via the gas inlet/vent line, and venting through a gas vent line operably connected to said pneumatic 3-way inlet control valve/vent valve.

37. The floatless pneumatic fluid pump apparatus of claim 34, wherein the standby procedure comprises:

receiving data from the liquid sensor, indicating the absence of a known amount of liquid/leachate in the fluid outlet discharge line;

allowing the floatless pneumatic fluid pump apparatus to rest for a specific time period, allowing/leachate the opportunity to fill the fill cavity of the floatless pneumatic fluid pump before retesting the floatless pneumatic fluid pump apparatus with a test procedure to determine if a known amount of liquid/leachate has re-accumulated in the floatless pneumatic fluid pump apparatus.

38. The floatless pneumatic fluid pump apparatus of claim 34, wherein the test procedure comprises:

receiving data from the liquid sensor in the floatless pneumatic fluid pump apparatus on a regular or periodic basis to determine if a known amount of liquid/leachate has accumulated or is present in either the fill tank or the fluid outlet discharge line;

if liquid/leachate is detected, then the floatless pneumatic fluid pump apparatus is configured to continue with additional pump cycles to remove the liquid/leachate from the fill cavity and the well bore;

if liquid/leachate is not detected, then the floatless pneumatic fluid pump apparatus is configured to enter a standby period until the test procedure is repeated.

39. The floatless pneumatic fluid pump apparatus of claim 34, wherein said power source comprises:

an electrical power grid; or batteries; or a solar cell; or
a pneumatic turbine; or
a combination thereof.

* * * * *